US008914268B2

(12) United States Patent
Dale et al.

(10) Patent No.: US 8,914,268 B2
(45) Date of Patent: Dec. 16, 2014

(54) OPTIMIZING WELL OPERATING PLANS

(75) Inventors: Bruce A. Dale, Sugar Land, TX (US); Timothy K. Ellison, Houston, TX (US); Dieter Postl, Manvel, TX (US); Dar-Lon Chang, Sugar Land, TX (US); Jennifer Hommema, Pearland, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 252 days.

(21) Appl. No.: 13/133,895

(22) PCT Filed: Jan. 5, 2010

(86) PCT No.: PCT/US2010/020119

§ 371 (c)(1),
(2), (4) Date: Jun. 9, 2011

(87) PCT Pub. No.: WO2010/083072

PCT Pub. Date: Jul. 22, 2010

(65) Prior Publication Data

US 2011/0246163 A1 Oct. 6, 2011

Related U.S. Application Data

(60) Provisional application No. 61/144,307, filed on Jan. 13, 2009, provisional application No. 61/287,019, filed on Dec. 16, 2009.

(51) Int. Cl.
*G06G 7/58* (2006.01)
*E21B 43/00* (2006.01)

(52) U.S. Cl.
CPC ..... *E21B 43/00* (2013.01)
USPC ..... 703/10

(58) Field of Classification Search
USPC ..... 703/10
See application file for complete search history.

(56) References Cited

U.S. PATENT DOCUMENTS

| | | | |
|---|---|---|---|
| 4,137,969 | A | 2/1979 | Phalangas et al. |
| 4,204,574 | A | 5/1980 | Stalder |
| 4,687,059 | A | 8/1987 | Pathak et al. |
| 5,038,864 | A | 8/1991 | Dunleavy et al. |
| 5,058,012 | A | 10/1991 | Hinchman et al. |
| 5,095,989 | A | 3/1992 | Prukop |

(Continued)

OTHER PUBLICATIONS

Naevdal et al., Near-Well Reservoir Monitoring Through Ensemble Kalman Filter, Apr. 2002, SPE 75235, pp. 1-9.*

*Primary Examiner* — Kamini S Shah
*Assistant Examiner* — Juan Ochoa
(74) *Attorney, Agent, or Firm* — ExxonMobil Upstream Research Company—Law Department

(57) ABSTRACT

Methods and systems for making decisions related to the operation of a hydrocarbon well include characterizing effective production capacity of a reservoir over space and time based at least in part on a reservoir potential and a near-well capacity; determining an optimized well potential over space and time relative to the characterized effective production capacity using a well model of a simulated well accessing the reservoir, which may be determined based at least in part on an objective function that considers at least one of a plurality of decision-making factors, such as one or more of operations costs, operational risks, and modeled production rates over the life of the well; and determining at least one well operating plan component that can be incorporated into a well operating plan to provide the optimized well potential in a well accessing the reservoir.

22 Claims, 10 Drawing Sheets

(56) References Cited

U.S. PATENT DOCUMENTS

| | | | | |
|---|---|---|---|---|
| 5,416,697 | A | 5/1995 | Goodman | |
| 5,464,059 | A | 11/1995 | Kristiansen | |
| 5,632,336 | A | 5/1997 | Notz et al. | |
| 5,663,499 | A * | 9/1997 | Semmelbeck et al. | 73/152.06 |
| 6,016,868 | A | 1/2000 | Gregoli et al. | |
| 6,088,656 | A | 7/2000 | Ramakrishnan et al. | |
| 6,101,447 | A | 8/2000 | Poe, Jr. | |
| 6,109,368 | A | 8/2000 | Goldman et al. | |
| 6,182,756 | B1 | 2/2001 | Garcia et al. | |
| 6,196,318 | B1 | 3/2001 | Gong et al. | |
| 6,227,296 | B1 | 5/2001 | Reppert et al. | |
| 6,230,101 | B1 | 5/2001 | Wallis | |
| 6,266,619 | B1 | 7/2001 | Thomas et al. | |
| 6,460,006 | B1 | 10/2002 | Corcoran | |
| 6,549,854 | B1 | 4/2003 | Malinverno et al. | |
| 6,549,879 | B1 | 4/2003 | Cullick et al. | |
| 6,640,190 | B2 | 10/2003 | Nickel | |
| 6,654,692 | B1 | 11/2003 | Neff | |
| 6,662,146 | B1 | 12/2003 | Watts | |
| 6,668,922 | B2 | 12/2003 | Ziauddin et al. | |
| 6,745,159 | B1 | 6/2004 | Todd et al. | |
| 6,766,255 | B2 | 7/2004 | Stone | |
| 6,785,641 | B1 | 8/2004 | Huang | |
| 6,804,609 | B1 | 10/2004 | Brumbaugh | |
| 6,810,332 | B2 | 10/2004 | Harrison | |
| 6,810,370 | B1 | 10/2004 | Watts, III | |
| 6,813,564 | B2 | 11/2004 | Eiken et al. | |
| 6,823,297 | B2 | 11/2004 | Jenny et al. | |
| 6,826,486 | B1 | 11/2004 | Malinverno | |
| 6,836,731 | B1 | 12/2004 | Whalley et al. | |
| 6,840,317 | B2 | 1/2005 | Hirsch et al. | |
| 6,842,700 | B2 | 1/2005 | Poe | |
| 6,892,812 | B2 | 5/2005 | Niedermayr et al. | |
| 6,901,391 | B2 | 5/2005 | Storm, Jr. et al. | |
| 6,980,929 | B2 | 12/2005 | Aronstam et al. | |
| 6,980,940 | B1 | 12/2005 | Gurpinar et al. | |
| 7,054,752 | B2 | 5/2006 | Zabalza-Mezghani et al. | |
| 7,062,420 | B2 | 6/2006 | Poe, Jr. | |
| 7,066,019 | B1 | 6/2006 | Papanastasiou | |
| 7,069,148 | B2 | 6/2006 | Thambynayagam et al. | |
| 7,089,167 | B2 | 8/2006 | Poe | |
| 7,099,811 | B2 | 8/2006 | Ding et al. | |
| 7,177,764 | B2 | 2/2007 | Stone | |
| 7,181,380 | B2 | 2/2007 | Dusterhoft et al. | |
| 7,188,058 | B2 | 3/2007 | Hardy et al. | |
| 7,191,062 | B2 | 3/2007 | Chi et al. | |
| 7,200,539 | B2 | 4/2007 | Ong et al. | |
| 7,277,796 | B2 | 10/2007 | Kuchuk et al. | |
| 7,369,973 | B2 | 5/2008 | Kennon et al. | |
| 7,451,066 | B2 * | 11/2008 | Edwards et al. | 703/2 |
| 7,561,998 | B2 | 7/2009 | Panga et al. | |
| 7,657,415 | B2 | 2/2010 | Panga et al. | |
| 2002/0013687 | A1 | 1/2002 | Ortoleva | |
| 2002/0049575 | A1 | 4/2002 | Jalali et al. | |
| 2002/0055868 | A1 | 5/2002 | Dusevic et al. | |
| 2002/0084071 | A1 | 7/2002 | McCoy et al. | |
| 2002/0120429 | A1 | 8/2002 | Ortoleva | |
| 2003/0051873 | A1 | 3/2003 | Patzek et al. | |
| 2003/0220775 | A1 | 11/2003 | Jourdan et al. | |
| 2003/0225606 | A1 | 12/2003 | Raghuraman et al. | |
| 2004/0122640 | A1 | 6/2004 | Dusterhoft | |
| 2004/0205576 | A1 | 10/2004 | Chikirivao et al. | |
| 2004/0220790 | A1 | 11/2004 | Cullick et al. | |
| 2005/0015231 | A1 | 1/2005 | Edwards et al. | |
| 2005/0119911 | A1 * | 6/2005 | Ayan et al. | 705/1 |
| 2005/0121197 | A1 | 6/2005 | Lopez de Cardenas et al. | |
| 2005/0149307 | A1 | 7/2005 | Gurpinar et al. | |
| 2005/0199391 | A1 | 9/2005 | Cudmore et al. | |
| 2005/0267719 | A1 | 12/2005 | Foucault | |
| 2005/0273302 | A1 | 12/2005 | Huang et al. | |
| 2005/0273304 | A1 | 12/2005 | Oliver et al. | |
| 2006/0015310 | A1 | 1/2006 | Husen et al. | |
| 2006/0047489 | A1 | 3/2006 | Scheidt et al. | |
| 2006/0085174 | A1 | 4/2006 | Hemanthkumar et al. | |
| 2006/0122777 | A1 | 6/2006 | Patzek et al. | |
| 2006/0149518 | A1 | 7/2006 | Oliver et al. | |
| 2007/0156377 | A1 | 7/2007 | Gurpinar et al. | |
| 2007/0271077 | A1 | 11/2007 | Kosmala et al. | |
| 2007/0294034 | A1 | 12/2007 | Bratton et al. | |
| 2008/0033656 | A1 | 2/2008 | Herwanger | |
| 2008/0091396 | A1 | 4/2008 | Kennon et al. | |
| 2008/0120036 | A1 | 5/2008 | Kimminau et al. | |
| 2008/0172272 | A1 | 7/2008 | Back et al. | |
| 2009/0205819 | A1 | 8/2009 | Dale et al. | |
| 2009/0216508 | A1 | 8/2009 | Dale et al. | |
| 2010/0299111 | A1 | 11/2010 | Dale et al. | |

* cited by examiner

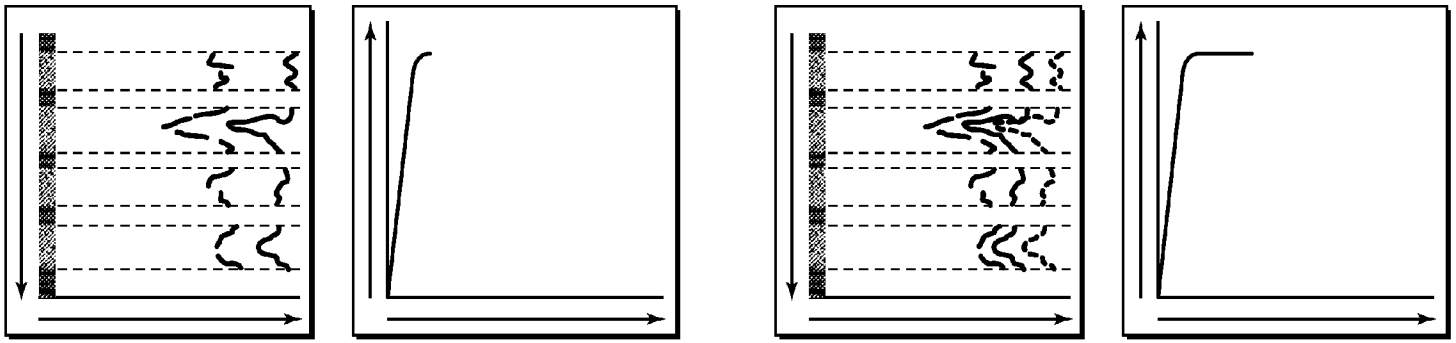
FIG. 11A
FIG. 11B
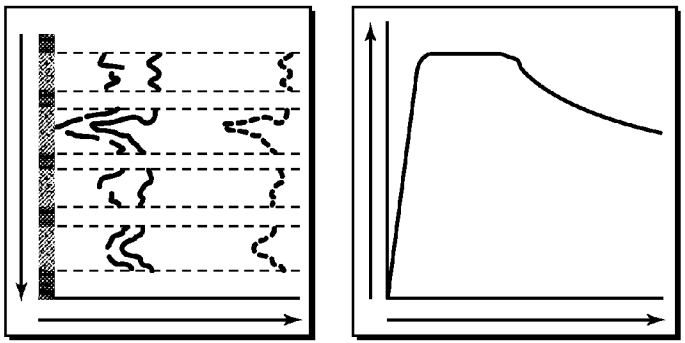
FIG. 11C

OPTIMIZING WELL OPERATING PLANS

CROSS-REFERENCE TO RELATED APPLICATIONS

This application is the National Stage of International Application No. PCT/US2010/020119, filed 5 Jan. 2010, which claims the benefit under 35 U.S.C. 119(*e*) of U.S. Provisional Application No. 61/144,307, filed 13 Jan. 2009 and U.S. Provisional Application No. 61/287,019, filed 16 Dec. 2009, which are incorporated herein by reference in their entirety for all purposes.

FIELD

The present disclosure relates generally to systems and methods for optimizing well operating plans and systems designed thereby. More specifically, the present disclosure relates to optimizing well operating plans by optimizing well potential relative to effective production capacity in light of dynamic reservoir conditions, dynamic near-well conditions, and dynamic well conditions over space and time.

BACKGROUND

This section is intended to introduce various aspects of the art, which may be associated with exemplary embodiments of the present invention. This discussion is believed to assist in providing a framework to facilitate a better understanding of particular aspects of the present invention. Accordingly, it should be understood that this section should be read in this light, and not necessarily as admissions of prior art.

To facilitate further discussion of the hydrocarbon recovery operations, FIG. 1 provides a schematic representation of a well together with surface facilities providing an exemplary production system 100. In the exemplary production system 100, a floating production facility 102 is coupled to a subsea tree 104 located on the sea floor 106. Through this subsea tree 104, the floating production facility 102 accesses one or more subsurface formations, such as subsurface formation 107, which may include multiple production intervals or zones 108*a*-108*n*, wherein number "n" is any integer number. The distinct production intervals 108*a*-108*n* may correspond to distinct reservoirs and/or to distinct formation types encompassed by a common reservoir. The production intervals 108*a*-108*n* correspond to regions or intervals of the formation having hydrocarbons (e.g., oil and/or gas) to be produced or otherwise acted upon (such as having fluids injected into the interval to move the hydrocarbons toward a nearby well, in which case the interval may be referred to as an injection interval). While FIG. 1 illustrates a floating production facility 102, it should be noted that the production system 100 is illustrated for exemplary purposes and the present discussion may be applied to wells coupled to any variety of surface facilities, such as may be implemented in land and/or water environments.

The floating production facility 102 may be configured to monitor and produce hydrocarbons from the production intervals 108*a*-108*n* of the subsurface formation 107. The floating production facility 102 may be a floating vessel capable of managing the production of fluids, such as hydrocarbons, from subsea wells. These fluids may be stored on the floating production facility 102 and/or provided to tankers (not shown). To access the production intervals 108*a*-108*n*, the floating production facility 102 is coupled to a subsea tree 104 and control valve 110 via a control umbilical 112. The control umbilical 112 may include production tubing for providing hydrocarbons from the subsea tree 104 to the floating production facility 102, control tubing for hydraulic or electrical devices, and/or a control cable for communicating with other devices within the well 114.

To access the production intervals 108*a*-108*n*, the well 114 penetrates the sea floor 106 to a depth that interfaces with the production intervals 108*a*-108*n* at different depths (or lengths in the case of horizontal or deviated wells) within the well 114. As may be appreciated, the production intervals 108*a*-108*n*, which may be referred to as production intervals 108, may include various layers or intervals of rock that may or may not include hydrocarbons and may be referred to as zones. The subsea tree 104, which is positioned over the well 114 at the sea floor 106, provides an interface between devices within the well 114 and the floating production facility 102. Accordingly, the subsea tree 104 may be coupled to a production tubing string 128 to provide fluid flow paths and a control cable (not shown) to provide communication paths, which may interface with the control umbilical 112 at the subsea tree 104.

Within the well 114, the production system 100 may also include different equipment to provide access to the production intervals 108*a*-108*n*. For instance, a surface casing string 124 may be installed from the sea floor 106 to a location at a specific depth beneath the sea floor 106. Within the surface casing string 124, an intermediate or production casing string 126, which may extend down to a depth near the production interval 108*a*, may be utilized to provide support for walls of the well 114. The surface and production casing strings 124 and 126 may be cemented into a fixed position within the well 114 to further stabilize the well 114. Within the surface and production casing strings 124 and 126, a production tubing string 128 may be utilized to provide a flow path through the well 114 for hydrocarbons and other fluids. A subsurface safety valve 132 may be utilized to block the flow of fluids from portions of the production tubing string 128 in the event of rupture or break above the subsurface safety valve 132. Further, packers 134 may be utilized to isolate specific zones within the well annulus from each other. The packers 134 may be configured to provide fluid communication paths between surface and the sand control devices 138*a*-138*n*, while preventing fluid flow in one or more other areas, such as a well annulus.

In addition to the above equipment, other equipment, such as sand control devices 138*a*-138*n*, may be utilized to manage the flow of fluids from within the well. In particular, the sand control devices 138*a*-138*n* may be utilized to manage the flow of fluids and/or particles into the production tubing string 128. The sand control devices 138*a*-138*n* may include slotted liners, stand-alone screens (SAS), pre-packed screens, wire-wrapped screens, membrane screens, expandable screens, and/or wire-mesh screens. The sand control devices 138*a*-138*n* may also include inflow control mechanisms, such as inflow control devices (e.g. valves, conduits, nozzles, or any other suitable mechanisms), which may increase pressure loss along the fluid flow path. Still additionally, gravel packs may be implemented together with the sand control devices. The sand control devices 138*a*-138*n* may include different components or configurations for any two or more of the intervals 108*a*-108*n* of the well to accommodate varying conditions along the length of the well. For example, the intervals 108*a*-108*b* may include a cased-hole completion and a particular configuration of sand control devices 138*a*-138*b* while interval 108*n* may be an open-hole interval of the well having a different configuration for the sand control device 138*n*.

Conventionally, packers or other flow control mechanisms are disposed between adjacent intervals 108 to enable adjacent intervals to be completed differently, such as including sand control in one interval while not in an adjacent interval. While multiple interval wells are relatively common, and while the completions within the different intervals may be different, the planning associated with the design of these completions is generally based on a relatively limited set of information. For example, the design may include sand control equipment in one interval and not in another based solely on observations about the type of rock in the interval or on experiences in nearby wells. Other aspects of conventional well completion design will be understood from the following discussion.

While hydrocarbons have been a source of energy for many years, the technology available for use in extracting hydrocarbons from the ground continues to evolve. In part, the need for continually advancing technology comes from the increasingly challenging circumstances in which hydrocarbons are found. For example, more and more wells are located in areas that are geographically challenging. Geographic complexities, such as reservoirs in arctic conditions, in deep water, or in otherwise challenging subsurface formations (sandy, unconsolidated formations, shale formations, etc.), can increase the costs and operational risks of drilling a well and of treating the well should hydrocarbon production fall below acceptable limits or should there be another problem with the well (such as sand or water production). Even in otherwise conventional fields and formations, the costs of workovers and other treatments are high. In addition to the lost revenues while the well is not producing at target rates, the costs of equipment and manpower during workovers and other treatments can run into millions of dollars. Accordingly, researchers are continually attempting to identify ways to improve the efficiency of wells and reservoirs.

One measure of the efficiency of a well or reservoir is the dollars invested per quantity of oil produced. Clearly, the efficiency is reduced as costs and risks are increased through workovers and other treatments. However, efficiency is also reduced when production rates and/or total production volumes are low. Accordingly, well operators typically attempt to build robust wells, to postpone workovers and treatments, and to produce at rates that will return the greatest total volume with the lowest maintenance costs. While these goals are obvious in themselves, accomplishing these goals is far from easy due to the complexity of the operations.

From a very simplified perspective, hydrocarbon operations include effectively two primary components: 1) the reservoir in which hydrocarbons are stored; and 2) the well through which hydrocarbons are produced to the surface. Well operators take the reservoir in the condition provided by nature. As used herein, the term "well operators" is used generically to refer to the multitude of personnel involved in the production of hydrocarbons including geoscientists, reservoir engineers, drilling personnel, completions personnel, treatment personnel, business managers and planners, etc. In contrast, operators go to great length to engineer the well and to operate it in a manner that will maximize production. The well is the component that the well operators can manipulate, treat, modify, etc. to control the rate at which fluids are produced to the surface. As used herein, the term "well" is used broadly to refer to the wellbore itself (the hole created through drilling operations) and the equipment installed, disposed, or used in the well.

While the reservoir consists of the rock and natural earth into which the well is drilled, it may be understood as having two component parts: the near-well region and the native reservoir. As is well understood, the term reservoir is used herein to refer to regions of the earth in which hydrocarbons or hydrocarbon precursors are disposed or stored. In some implementations, the well drilled to connect to the reservoir may intersect the reservoir directly. In other implementations, the well may be disposed near the reservoir and be operatively connected to the reservoir through a variety of conventional means. Regardless of the relationship between the well and the physical location of the hydrocarbons, the drilling, the completion, and/or the existence of the well often affects the nature of the formation in the area adjacent the well rendering the near-well region distinct from the native reservoir in at least one manner, as is well understood by those in the industry. For the purposes of the present disclosure, the term near-well region refers to those portions of the formation that are affected by operations in the wellbore, such as drilling operations, completion operations, injection operations, fracture operations, acid treatments, etc.

While this relationship between the well, the near-well, and the reservoir has been appreciated for many years, conventional methods for designing wells and well operating plans, including completions and production operations, do not account for the dynamic behavior that affects well performance during the life of a well. For example, the near-well region that is the most dynamic portion of the formation is not distinguished from the reservoir during the reservoir modeling used to predict production rates and volumes. While reservoir models are increasing in sophistication, completion details and near-well phenomena are either neglected entirely or given simplistic treatment. For example, most reservoir models treat wells as boundary conditions providing an inlet to or an outlet from the overall reservoir system rather than the complex combination of equipment disposed in and methods performed on a well. Drilling operations and completion procedures, such as perforating, gravel packing, hydraulic fracturing, acidizing, etc., are, when considered, considered merely by means of a mathematical correction factor commonly referred to as a "skin factor." Complex completions equipment are commonly neglected entirely in predicting production performance of a reservoir. In many circumstances, reservoir engineers determine predicted production performances with an assumed skin factor establishing the performance expectations. The drilling and subsurface engineers are then expected to provide a completed well with a skin factor less than the factor used in the assumptions. In many implementations, the estimated skin factor of the final completion design is never incorporated into the reservoir simulations for more accurate production performance predictions.

FIG. 2 is representative of a conventional inflow performance analysis 200 that is generally used to make well construction and completion decisions. In FIG. 2, flow rate 202 is plotted along the x-axis while flowing bottomhole pressure 204 is plotted along the y-axis. The initial inflow performance curve 206 is illustrated by the solid line while the initial tubing performance 208, or well performance, is illustrated by the dash-dot line. In effect, the conventional inflow performance analysis consists of predicting the initial production rate as a function of bottomhole pressure 204. The initial production rate is predicted using reservoir models adapted to model the ability of the reservoir to deliver fluids to a well at a particular location. Conventionally, that well is modeled as a single, uniform, static pressure sink into which fluids from the reservoir may flow. Additionally, the reservoir models used to predict the initial production rate fail to consider the nature or properties of the near-well region that is created by the drilling and completing of the well. The initial tubing performance 208 is predicted for a selected well design using conventional well modeling tools. The intersection 210 of the two plots identifies the target flowing bottomhole pressure and the target initial production rate for initial production operations. Initial tubing performance curves may be generated for a variety of well designs until a preferred combination of initial production rate and bottomhole pressure is identified.

While the inflow performance analysis 200 of FIG. 2 may be used to identify a target operating condition, it fails to consider several factors that are typically addressed by an operator before establishing the operating conditions for a well. For example, most operators understand that it is desirable to operate a well with some degree of uplift potential to naturally drive the produced fluids to the surface. Accordingly, while the well and completions are adapted to operate with the higher flow rates and pressures available from the reservoir, the well is typically operated to have a well potential somewhat lower than the reservoir potential. The degree of separation between the well potential and the reservoir potential is generally considered as the uplift potential. The uplift potential may be created or controlled during operation by choking the well or through other conventional means. In the interest of clarity, the terms reservoir potential and well potential should be understood to refer to the reservoir's potential to drive fluids toward the well and the well's potential to accept or receive such fluids and carry the same to the surface, each of which may be measured as a flow rate, a pressure, or other suitable measurement.

Additionally, many operators now recognize the desirability of multi-zone or multi-interval wells and may vary the well completion and/or operating conditions along the contact length of the well. Accordingly, the inflow performance analysis 200 may be performed for each interval to identify target operating conditions for that interval.

FIG. 3 presents a schematic representation of a conventional manner in which an operator may consider the reservoir potential and the well potential in designing a well, a completion, and/or operating conditions. The plot 300 of FIG. 3 represents the production potential 312 along the x-axis and the reservoir contact profile 314 along the y-axis. As illustrated, the well contacts the reservoir in four intervals 316 separated by packers 318. Additionally, the plot 300 presents the modeled reservoir potential 322 and the modeled well potential 324 in each of the intervals 316. As reflected in the illustration, the reservoir potential is conventionally modeled as a potential for the entire reservoir and is not modeled for specific completion intervals. Moreover, as reflected in the illustration, the well potential is modeled at a finer scale and may vary between the intervals. For example, interval 316*d* may have a higher well potential than interval 316*c* due to being completed as an open hole (316*d*) rather than a cased hole with perforations (316*c*). Still further, some well modeling tools may utilize full-physics modeling methods to produce a still finer scale model of the well potential, such as shown in interval 316*b*. The modeled well potential 324 of interval 316*b* may result from a variety of completion tools and/or from a variety of drilling circumstances. As discussed above, the well potential 324 may be intentionally established or controlled to be some degree less than the reservoir potential 322 to provide uplift potential.

While such planning and design methods have worked relatively well in the past, they are focused on making the initial completion designs and on maintaining production rates and volumes at levels established before the well is drilled. For example, while certain production problems may have presented themselves at a given time in a first well, by the time the second well, which is designed based on the experiences of the first well, reaches that given time in its life, the reservoir has changed dramatically through continued production operations and resultant depletion.

Thus far, much of the discussion has focused on designing wells and completions so as to maximize the initial production. While the balance between reservoir potential and well potential is important in the construction and completion of new wells, it is also important in considering proposed workovers of wells that are already suffering reduced production rates. For example, the relative impacts of different workover procedures and/or different completion equipment that may be installed during the workover may be considered. While these impacts are considered today, the consideration is limited to the same types of analysis described above—considering the inflow performance rate of the reservoir on average and the average tubular performance rate. In short, the conventional methods fail to adequately consider: 1) the range of completions technologies available; 2) the ability to customize the completion along the length of the well; and 3) the changes that occur in a well and in the near-well region as a reservoir is produced.

Well operators, and particularly completions engineers, are constantly challenged to produce wells at the highest rate possible and to extract the maximum total hydrocarbons possible from a reservoir. These objectives are often in conflict as producing a given well at high current rates may present risks to the well and/or to the reservoir. For example, a reservoir may have a high reservoir potential, which may be considered to be the potential or driving force moving fluids towards a well. A well completion designed to minimize the skin so as to allow maximum flow into the well may result in high initial production rates from such a reservoir. However, the same completion having low skin disposed in a poorly consolidated formation may lead to sand production in the well. Such a well would have high production rates for a short period of time before production is reduced due to excess sand production. Sand production is one of many challenges or obstacles that may be confronted when wells are designed merely to maximize initial hydrocarbon production rates.

These risks and challenges to maximizing total production are recognized by the industry. Various tools and equipment have been developed to provide complex completions in an effort to control the flow of fluids to maximize production while minimizing workovers. As introduced above, wells having multiple isolated intervals are common. Additionally, various examples of adaptable completions have been proposed, including completion equipment that is controllable from the surface and completion equipment that self-adapts under varying conditions in the well.

The increasing complexity of modern fields and reservoirs and the increasing complexity of modern wells and well technology have rendered the conventional well production planning tools insufficient for optimizing modern operations. While any of the various completions equipment configurations and methods may be applied in a given well to obtain or pursue optimized production rates, the challenge remains in identifying which type to use, how to configure the equipment, and where in the well it should be disposed for maximum cost benefit. Additionally, because the impact of the completion and/or workover decisions and operations on the formation is not reflected in the reservoir models of the conventional methods, it is not possible to determine how much more production, either in current rate or total volume, might be available through continued improvements to the completion.

The foregoing discussion of need in the art is intended to be representative rather than exhaustive. Technology addressing one or more such needs, or some other related shortcoming in the field, would benefit well planning and reservoir development planning, for example, providing decisions or plans for constructing, completing, operating, and/or treating a well and/or developing a reservoir more effectively and more profitably.

SUMMARY

The present disclosure provides methods for hydrocarbon well decision-making. The methods include: characterizing reservoir potential of a reservoir over space and time using a reservoir model; characterizing near-well capacity of a formation adjacent to a well drilled to access the reservoir using a near-well model of a simulated well accessing the reservoir; characterizing an effective production capacity based at least in part on the characterized reservoir potential and the characterized near-well capacity; determining an optimized well potential over space and time relative to the characterized effective production capacity using a well model of the simulated well accessing the reservoir; and determining at least one well operating plan component that can be incorporated into a well operating plan to provide the optimized well potential in a well accessing the reservoir.

Additionally, the present disclosure provides systems associated with the production of hydrocarbons. The systems include a well operatively connected to a subsurface reservoir. The well includes at least one component selected based at least in part on a computerized simulation adapted to: 1) characterize reservoir potential of the reservoir over space and time using a reservoir model; 2) characterize near-well capacity of a formation adjacent to the well using a near-well model of a simulated well accessing the reservoir; 3) characterize an effective production capacity based at least in part on the near-well capacity and the reservoir potential; 4) determine an optimized well potential over space and time relative to the characterized effective production capacity using a well model of the simulated well accessing the reservoir; and 5) determine at least one component that can be incorporated into a well operating plan to provide the optimized well potential in the well.

Additionally, the present disclosure provides systems for optimizing hydrocarbon well decision-making. Exemplary systems include: a processor; a storage medium; and a computer application accessible by the processor and stored on at least one of the storage medium and the processor. The computer application is adapted to: 1) characterize reservoir potential of the reservoir over space and time using a reservoir model; 2) characterize near-well capacity of a formation adjacent to the well using a near-well model of a simulated well accessing the reservoir; 3) characterize an effective production capacity based at least in part on the near-well capacity and the reservoir potential; 4) determine an optimized well potential over space and time relative to the characterized effective production capacity using a well model of the simulated well accessing the reservoir; and 5) determine at least one component that can be incorporated into a well operating plan to provide the optimized well potential in the well.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

While the present disclosure is susceptible to various modifications and alternative forms, specific exemplary implementations thereof have been shown in the drawings and are herein described in detail. It should be understood, however, that the description herein of specific exemplary implementations is not intended to limit the disclosure to the particular forms disclosed herein. This disclosure is to cover all modifications and equivalents as defined by the appended claims. It should also be understood that the drawings are not necessarily to scale, emphasis instead being placed upon clearly illustrating principles of exemplary embodiments of the present invention. Moreover, certain dimensions may be exaggerated to help visually convey such principles. Further where considered appropriate, reference numerals may be repeated among the drawings to indicate corresponding or analogous elements. Moreover, two or more blocks or elements depicted as distinct or separate in the drawings may be combined into a single functional block or element. Similarly, a single block or element illustrated in the drawings may be implemented as multiple steps or by multiple elements in cooperation.

FIGS. 11A-11C provide schematic representations of effective production capacity and well potential by interval at different times and production rate histories over time.

DETAILED DESCRIPTION

Terms and Terminology

Figure 1:
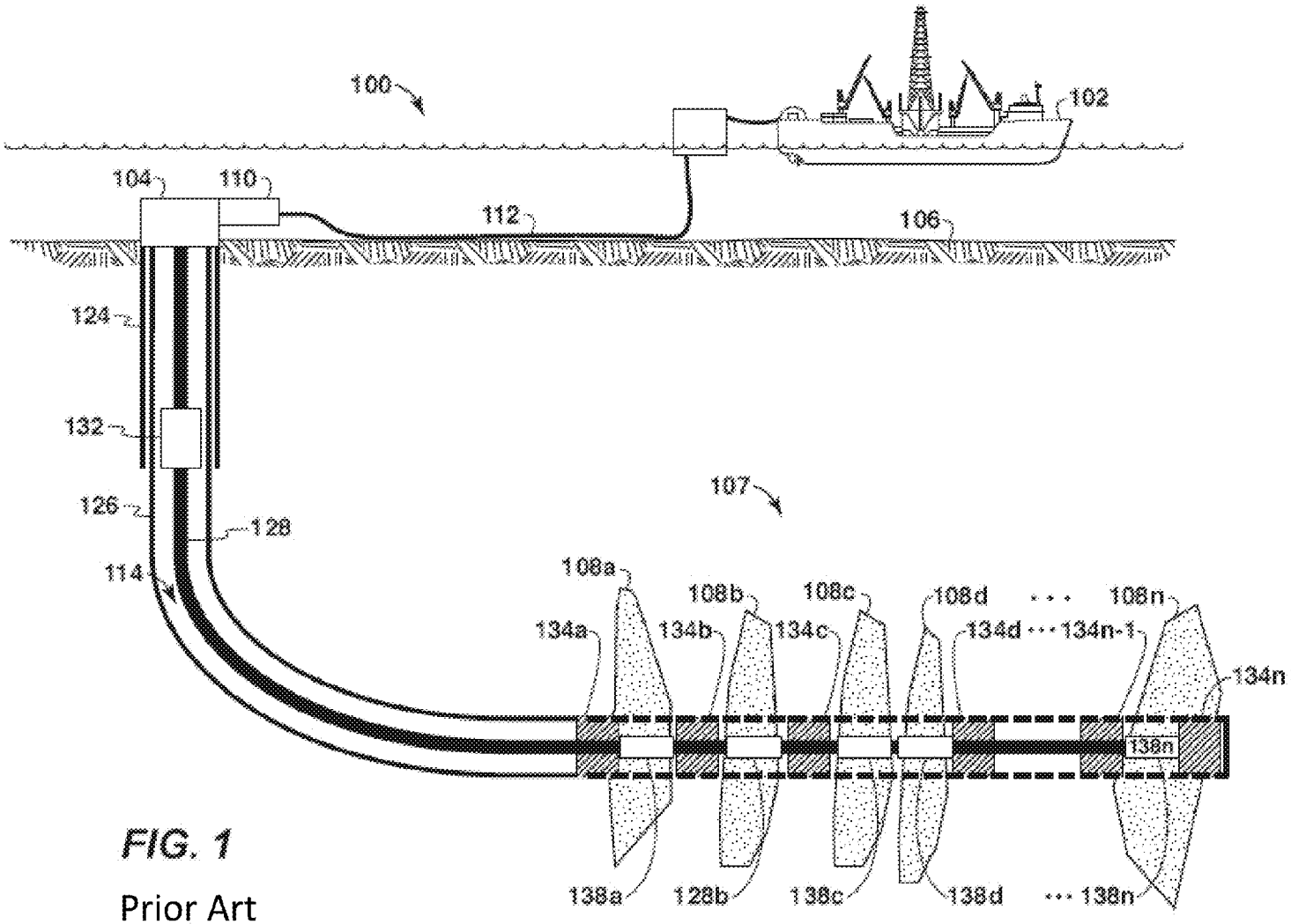
FIG. 1 Prior Art
FIG. 1 provides a schematic illustration of a hydrocarbon production system.
Figure 2:
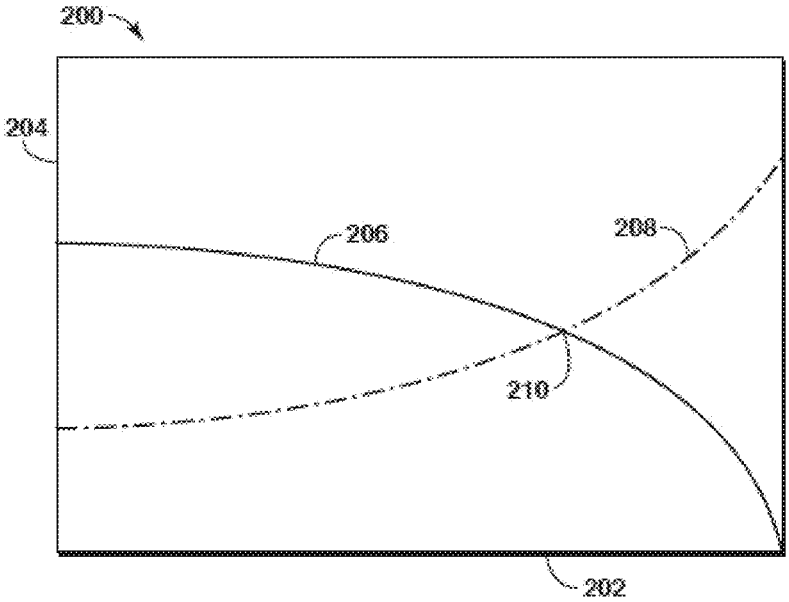
FIG. 2 Prior Art
FIG. 2 illustrates a conventional production planning graph.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than the broadest meaning understood by skilled artisans, such a special or clarifying definition will be expressly set forth in the specification in a definitional manner that provides the special or clarifying definition for the term or phrase.

For example, the following discussion contains a non-exhaustive list of definitions of several specific terms used in this disclosure (other terms may be defined or clarified in a definitional manner elsewhere herein). These definitions are intended to clarify the meanings of the terms used herein. It is believed that the terms are used in a manner consistent with their ordinary meaning, but the definitions are nonetheless specified here for clarity.

A/an: The indefinite articles "a" and "an" as used herein mean one or more when applied to any feature in embodiments and implementations of the present invention described in the specification and claims. The use of "a" and "an" does not limit the meaning to a single feature unless such a limit is specifically stated. The term "a" or "an" entity refers to one or more of that entity. As such, the terms "a" (or "an"), "one or more" and "at least one" can be used interchangeably herein.

About: As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents which may otherwise be afforded a particular value. Further, unless otherwise stated, the term "about" shall expressly include "exactly," consistent with the discussion below regarding ranges and numerical data.

Above/below: In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore. Continuing with the example of relative directions in a wellbore, "upper" and "lower" may also refer to relative positions along the longitudinal dimension of a wellbore rather than relative to the surface, such as in describing both vertical and horizontal wells.

And/or: The term "and/or" placed between a first entity and a second entity means one of (1) the first entity, (2) the second entity, and (3) the first entity and the second entity. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements). As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of"

Any: The adjective "any" means one, some, or all indiscriminately of whatever quantity.

At least: As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements). The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Based on: "Based on" does not mean "based only on", unless expressly specified otherwise. In other words, the phrase "based on" describes both "based only on," "based at least on," and "based at least in part on."

Comprising: In the claims, as well as in the specification, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

Couple: Any use of any form of the terms "connect", "engage", "couple", "attach", or any other term describing an interaction between elements is not meant to limit the interaction to direct interaction between the elements and may also include indirect interaction between the elements described.

Determining: "Determining" encompasses a wide variety of actions and therefore "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

Embodiments: Reference throughout the specification to "one embodiment," "an embodiment," "some embodiments," "one aspect," "an aspect," "some aspects," "some implementations," "one implementation," "an implementation," or similar construction means that a particular component, feature, structure, method, or characteristic described in connection with the embodiment, aspect, or implementation is included in at least one embodiment and/or implementation of the claimed subject matter. Thus, the appearance of the phrases "in one embodiment" or "in an embodiment" or "in some embodiments" (or "aspects" or "implementations") in various places throughout the specification are not necessarily all referring to the same embodiment and/or implementation. Furthermore, the particular features, structures, methods, or characteristics may be combined in any suitable manner in one or more embodiments or implementations.

Exemplary: "Exemplary" is used exclusively herein to mean "serving as an example, instance, or illustration." Any embodiment described herein as "exemplary" is not necessarily to be construed as preferred or advantageous over other embodiments.

Flow diagram: Exemplary methods may be better appreciated with reference to flow diagrams or flow charts. While for purposes of simplicity of explanation, the illustrated methods are shown and described as a series of blocks, it is to be appreciated that the methods are not limited by the order of the blocks, as in different embodiments some blocks may occur in different orders and/or concurrently with other blocks from that shown and described. Moreover, less than all the illustrated blocks may be required to implement an exemplary method. In some examples, blocks may be combined, may be separated into multiple components, may employ additional blocks, and so on. In some examples, blocks may be implemented in logic. In other examples, processing blocks may represent functions and/or actions performed by functionally equivalent circuits (e.g., an analog circuit, a digital signal processor circuit, an application specific integrated circuit (ASIC)), or other logic device. Blocks may represent executable instructions that cause a computer, processor, and/or logic device to respond, to perform an action(s), to change states, and/or to make decisions. While the figures illustrate various actions occurring in serial, it is to be appreciated that in some examples various actions could occur concurrently, substantially in parallel, and/or at substantially different points in time. In some examples, methods may be implemented as processor executable instructions. Thus, a machine-readable medium may store processor executable instructions that if executed by a machine (e.g., processor) cause the machine to perform a method.

Full-physics: As used herein, the term "full-physics," "full physics computational simulation," or "full physics simulation" refers to a mathematical algorithm based on first principles that impact the pertinent response of the simulated system.

May: Note that the word "may" is used throughout this application in a permissive sense (i.e., having the potential to, being able to), not a mandatory sense (i.e., must).

Operatively connected and/or coupled: Operatively connected and/or coupled means directly or indirectly connected for transmitting or conducting information, force, energy, or matter.

Optimizing: The terms "optimal," "optimizing," "optimize," "optimality," "optimization" (as well as derivatives and other forms of those terms and linguistically related words and phrases), as used herein, are not intended to be limiting in the sense of requiring the present invention to find the best solution or to make the best decision. Although a mathematically optimal solution may in fact arrive at the best of all mathematically available possibilities, real-world embodiments of optimization routines, methods, models, and processes may work towards such a goal without ever actually achieving perfection. Accordingly, one of ordinary skill in the art having benefit of the present disclosure will appreciate that these terms, in the context of the scope of the present invention, are more general. The terms may describe one or more of: 1) working towards a solution which may be the best available solution, a preferred solution, or a solution that offers a specific benefit within a range of constraints; 2) continually improving; 3) refining; 4) searching for a high point or a maximum for an objective; 5) processing to reduce a penalty function; 6) seeking to maximize one or more factors in light of competing and/or cooperative interests in maximizing, minimizing, or otherwise controlling one or more other factors, etc.

Order of steps: It should also be understood that, unless clearly indicated to the contrary, in any methods claimed herein that include more than one step or act, the order of the steps or acts of the method is not necessarily limited to the order in which the steps or acts of the method are recited.

Preferred: "preferred" and "preferably" refer to embodiments of the invention that afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

Ranges: Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a range of about 1 to about 200 should be interpreted to include not only the explicitly recited limits of 1 and about 200, but also to include individual sizes such as 2, 3, 4, etc. and sub-ranges such as 10 to 50, 20 to 100, etc. Similarly, it should be understood that when numerical ranges are provided, such ranges are to be construed as providing literal support for claim limitations that only recite the lower value of the range as well as claims limitation that only recite the upper value of the range. For example, a disclosed numerical range of 10 to 100 provides literal support for a claim reciting "greater than 10" (with no upper bounds) and a claim reciting "less than 100" (with no lower bounds).

DESCRIPTION

Reference will now be made to exemplary embodiments and implementations. Alterations and further modifications of the inventive features described herein and additional applications of the principles of the invention as described herein, such as would occur to one skilled in the relevant art having possession of this disclosure, are to be considered within the scope of the invention. Further, before particular embodiments of the present invention are disclosed and described, it is to be understood that this invention is not limited to the particular process and materials disclosed herein as such may vary to some degree. Moreover, in the event that a particular aspect or feature is described in connection with a particular embodiment, such aspects and features may be found and/or implemented with other embodiments of the present invention where appropriate. Specific language may be used herein to describe the exemplary embodiments and implementations. It will nevertheless be understood that such descriptions, which may be specific to one or more embodiments or implementations, are intended to be illustrative only and for the purpose of describing one or more exemplary embodiments. Accordingly, no limitation of the scope of the invention is thereby intended, as the scope of the present invention will be defined only by the appended claims and equivalents thereof.

In the interest of clarity, not all features of an actual implementation are described in this disclosure. For example, some well-known features, principles, or concepts, are not described in detail to avoid obscuring the invention. It will be appreciated that in the development of any actual embodiment or implementation, numerous implementation-specific decisions may be made to achieve the developers' specific goals, such as compliance with system-related and business-related constraints, which will vary from one implementation to another. For example, the specific details of an appropriate computing system for implementing methods of the present invention may vary from one implementation to another. Moreover, it will be appreciated that such a development effort might be complex and time-consuming, but would nevertheless be a routine undertaking for those of ordinary skill in the art having the benefit of the present disclosure.

Figure 4:
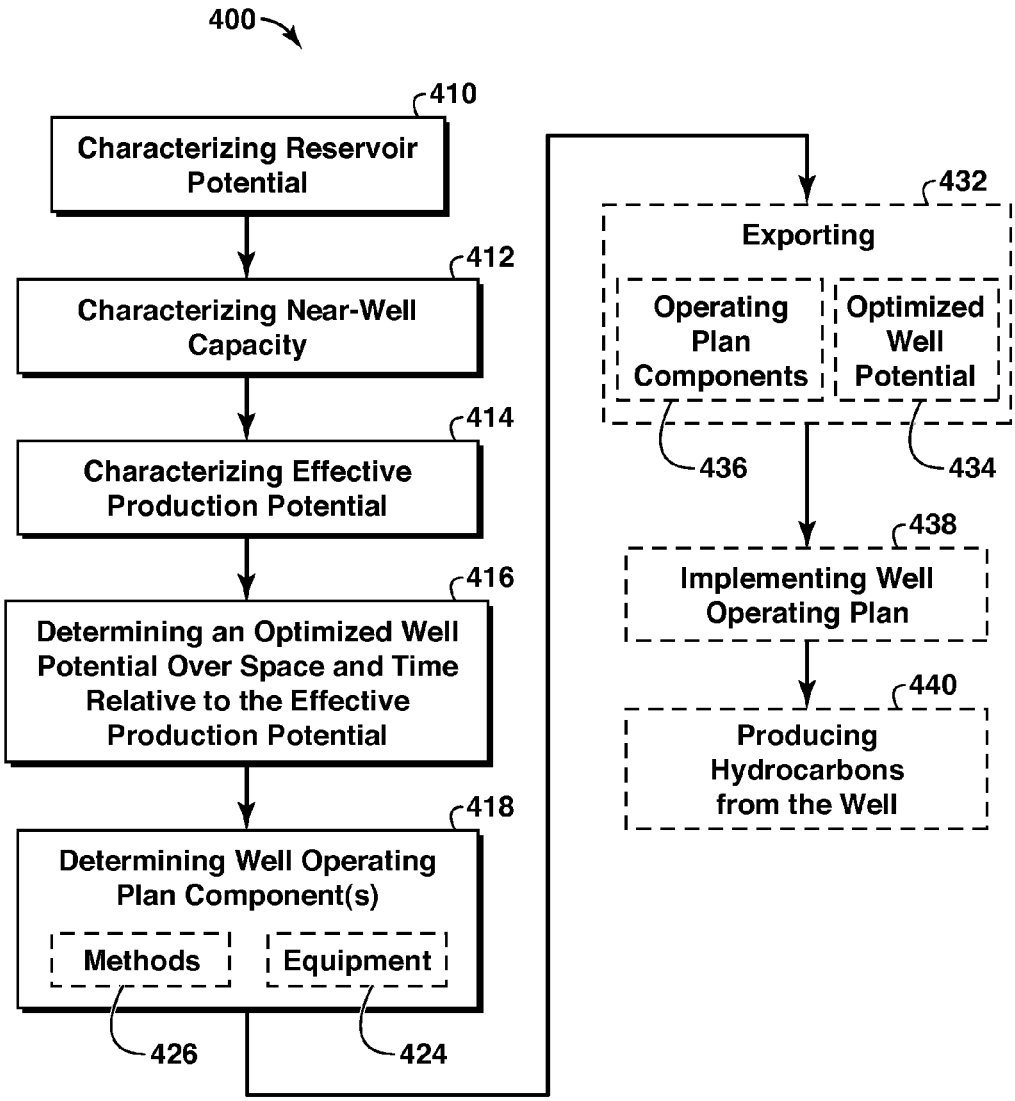
FIG. 4 provides a flowchart of methods within the scope of the present inventions.

FIG. 4 provides a schematic flow chart of representative methods within the scope of the present disclosure. By way of custom, steps represented by boxes in solid lines are steps that are described in the principle implementations. Those steps or features represented by boxes in dashed lines are representative of optional additional or supplemental steps and/or optional details, features, or sub-steps. As illustrated in FIG. 4, the present disclosure provides methods for making decisions related to hydrocarbon wells, which decision-making methods 400 include five primary steps: 1) characterizing reservoir potential 410; 2) characterizing near-well capacity 412; 3) characterizing effective production capacity 414; 4) determining an optimized well potential 416; and 5) determining well operating plan components 418. The methods will be further described in greater detail below.

The step of characterizing the reservoir potential 410 of a reservoir may be performed using a reservoir model to characterize the reservoir potential over space and time. As indicated above, reservoir potential may be considered to be the driving force moving fluids from the formation (i.e., reservoir) towards the well and represents the formation's native ability to transmit fluids. Accordingly, reservoir potential may vary over space depending on the nature of the formation and may vary over time as the reservoir is depleted. Some implementations may utilize one or more models where the reservoir is simulated in cooperation with a well that is modeled as a simple inlet/outlet disregarding complexities in well construction and operation, skin factors, variations in the formation that might be caused by the drilling and/or completion of an actual well, and other factors that might limit the actual production rate and/or ability of a well to receive the driven formation fluids. Accordingly, as described above, the reservoir potential may be considered to be the conventional reservoir potential modeled by reservoir engineers using conventional modeling tools.

As indicated, one or more reservoir models may be used to determine the reservoir potential, which models may be used alone or in conjunction with other models commonly used in the industry. Depending on the models used to characterize reservoir potential, the reservoir potential may be measured in units of pressure, flow rate, permeability, and/or some combination of the above. A variety of models of differing complexities may be used as the reservoir model. For example, complex reservoir models, such as commercially available reservoir simulators and/or proprietary reservoir simulators, may be used to characterize the reservoir potential over space and time. Additionally or alternatively, simpler models may provide sufficient characterizations of reservoir potential over space and time. Accordingly, models ranging from full-physics reservoir models, to full-field reservoir simulators, to engineering solutions, such as parametric models, simple material balance models, and experienced approximations, may be used in characterizing the reservoir potential 410. The complexity of the reservoir model selected may affect the computational intensity of the present methods and the robustness of the results of the present methods. In some aspects of the present methods, complex reservoir models can be implemented in an algorithm to provide robust and accurate results while minimizing the computational intensity.

Returning to FIG. 4, the present decision-making methods include characterizing the near-well capacity at 412. The step of characterizing the near-well capacity recognizes that the formation in the region adjacent a well behaves and has properties drastically different from either the native reservoir or the well itself. As a simplified example, a loosely consolidated formation adjacent the well behaves differently from a loosely consolidated formation distant from the well. The loosely consolidated formation near the well may result in sand production into the well, while the loosely consolidated formation distant from the well may have very little current impact on the production operations. Similarly, a fracture extending into the near-well region will cause the formation near the fracture to behave dramatically differently than the native formation of the reservoir. The large variety of factors that may make the near-well region different from the reservoir may be readily identified by those of ordinary skill in the art.

While the variety of factors that affects the near-well region is readily understood, the near-well region is not typically modeled in isolation. While the near-well region may be modeled in any suitable manner, the near-well model of the present methods is adapted to characterize the near-well capacity, at 412. The near-well capacity represents the capacity of the near-well region to flow fluids therethrough without triggering or initiating a negative production event, such as sand production, compaction, water production, etc. Due to the variety of factors that affect the near-well region and the multitude of manners in which a negative production event may be initiated, the near-well model used to characterize the near-well capacity, at 412, may be based at least in part on full-physics modeling of a simulated well accessing the reservoir. Additionally or alternatively, other modeling techniques may be used, such as engineering approximations, numerical simulations, etc. In any event, the near-well model characterizes the near-well region at a finer scale and is better able to account for spatial and temporal differences in the near-well formation and in the drilling, completion, production, and treatment operations. Accordingly, the near-well model is able to characterize the near-well capacity.

Figure 3:
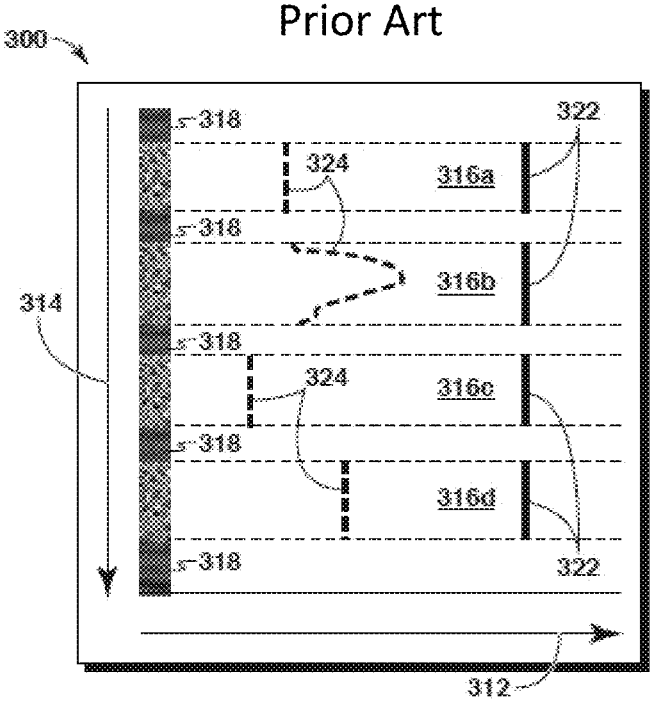
FIG. 3 Prior Art
FIG. 3 provides a schematic representation of reservoir potential and well potential.
Figure 5:
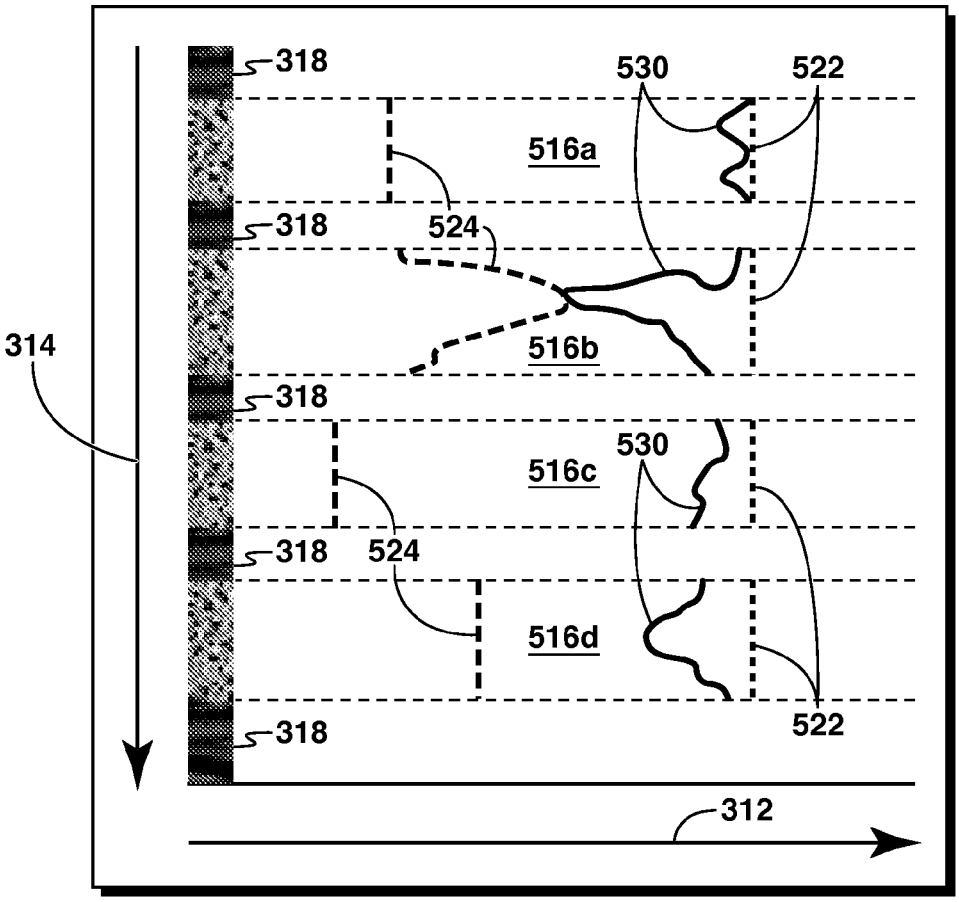
FIG. 5 provides a schematic representation of reservoir potential, well potential, and effective production capacity as may be determined by the present methods.

FIG. 4 further illustrates that the present methods include characterizing the effective production capacity at 414 based at least in part on the near-well capacity and the reservoir potential. The near-well capacity and the reservoir potential may be associated in a variety of manners to facilitate the characterization of the effective production capacity. For example, the reservoir model may provide and time and/or space dependent inputs into the near-well model. Additionally or alternatively, the near-well model and the reservoir model may be mathematically coupled such that variations in the reservoir model output results in a re-iteration of the near-well model to update the characterized near-well capacity. Still additionally or alternatively, the near-well model may be adapted to produce a degree of deviation that is layered on the characterized reservoir potential. For example, the near-well model may be adapted to indicated that the near-well capacity is 10% lower than the reservoir potential, which may then be combined with the reservoir potential to determined the effective production capacity. FIG. 5 graphically illustrates the result of characterizing the effective production capacity based at least in part on the near-well capacity and the reservoir capacity. That is, FIG. 5 graphically illustrates the characterized reservoir potential 522 (as in FIG. 3), in dotted lines, and the resultant characterized effective production capacity 530, in solid lines, after the near-well capacity is considered. The remaining elements of FIG. 5 are as described in connection with FIG. 3 with like reference numbers referring to the previously described elements.

As seen in FIG. 5, the effective production capacity 530 may deviate to varying degrees from the reservoir potential. The representative effective production capacity 530 of FIG. 5 is merely illustrative as the specific degrees of variation will clearly vary from well to well and from interval to interval. However, the illustrative representation of FIG. 5 highlights an aspect of the present methods: the effective production capacity 530 may have a greater impact on the total production volume and on the production rate than does the reservoir potential. This can be most clearly seen in interval 516*b* where the effective production capacity is significantly lower than the reservoir potential. As can be understood from the foregoing discussion, the effective production capacity may be lower than the reservoir potential in this interval for a variety of reasons. For example, it may be that the formation is loosely consolidated and that producing at a rate corresponding to the reservoir potential may result in sand production. A host of other near-well region factors that may limit the desired production rate may similarly cause the effective production capacity to be lower than the reservoir potential. Considering the illustrated effective production capacity 530 and well potential 524, it can be seen that the well potential and the effective production capacity are intersecting or nearly intersecting in interval 516*b*. Translating the graphical representation to what is occurring downhole, the circumstances illustrated in interval 516*b* results in the well accepting fluids at a rate equal (or near equal) to the rate at which a negative production event is expected to occur. Because the reservoir is capable of producing at that rate, due to the higher reservoir potential 522, the fluids will be produced at the rate allowed by the well potential 524. In conventional operations, sand production or another negative production event would occur in interval 516*b* before the operators are alerted to the need to choke the well or otherwise treat the well to reduce the well potential in interval 516*b*.

With the technologies of the present disclosure, particularly the ability to distinctly characterize the near-well capacity and the effective production capacity, operators are able to determine an optimized well potential over space and time relative to the characterized effective production capacity, as illustrated in FIG. 4 at box 416. Continuing with the representative example of FIG. 5, the determined optimized well potential in interval 516*b* may be somewhat lower than that illustrated to avoid, or at least reduce the risk of, a negative production event. As will be discussed further herein, the well potential in interval 516*b* may be reduced in a variety of manners, such as choking the entire well, treating the interval, incorporating controllable completions equipment during the completion of the well, incorporating adaptive completions equipment during the completion of the well, etc.

The optimized well potential may be determined using a well model to consider the impact on the well potential of various drilling, completion, and/or production operations. Well models of a variety of configurations may be constructed to simulate the behavior of the well during production operations, the complexity of which may depend on the nature of the well. In some implementations, the well model may be selected from any commercially available well model. Additionally or alternatively, the well model may comprise engineering models of varying complexity, numerical simulations of varying complexity, approximations, etc. For example, operators may choose to consider a range of relevant factors that will affect the well potential of a given well. Exemplary factors include, but are not limited to, the depth and direction of the well, the completion architecture (cased or open hole), the perforation strategy (when cased), the presence of sand control equipment, inflow control equipment, etc.

While any one or more of these factors may be considered by a suitable well model, some implementations of the present methods may utilize a well model based at least in part on full-physics modeling of a simulated well accessing the reservoir. By utilizing full-physics modeling of the simulated well, processes that impact the well potential of the simulated well are modeled based on first principles. Full-physics modeling of simulated wells is an emerging technology that can be implemented in a variety of computational environments. The mathematical models constituting the full-physics models may vary from one implementation to another according to the particulars of a given well and/or the preferences and/or judgment of a given operator conducting the simulation. Full-physics models typically include mathematical relationships between two or more mathematical models of real-world conditions. Just as the selection of particular mathematical models may vary from one implementation to another, the mathematical relationships between such models may vary depending on conditions of the well being simulated and/or the preferences and/or judgment of the operator conducting the simulation. Accordingly, a variety of full-physics models may be used in determining the well potential of a simulated well accessing the reservoir.

Figure 6A:
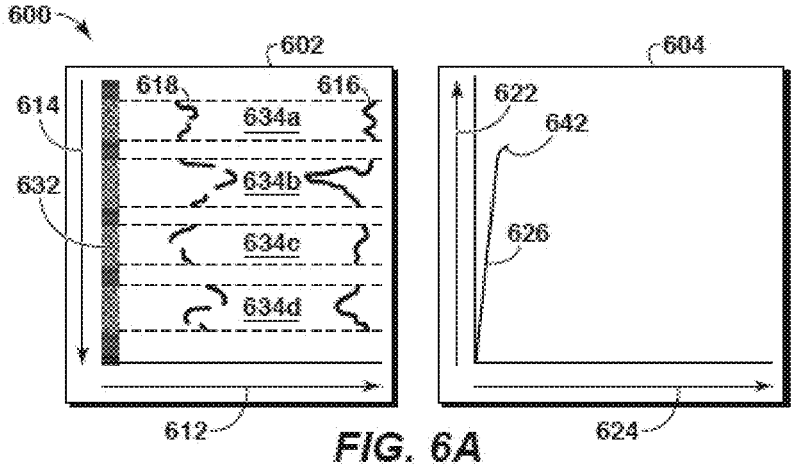
FIGS. 6A-6C provide schematic representations of effective production capacity and well potential by interval at different times and production rate histories over time.
Figure 6B:
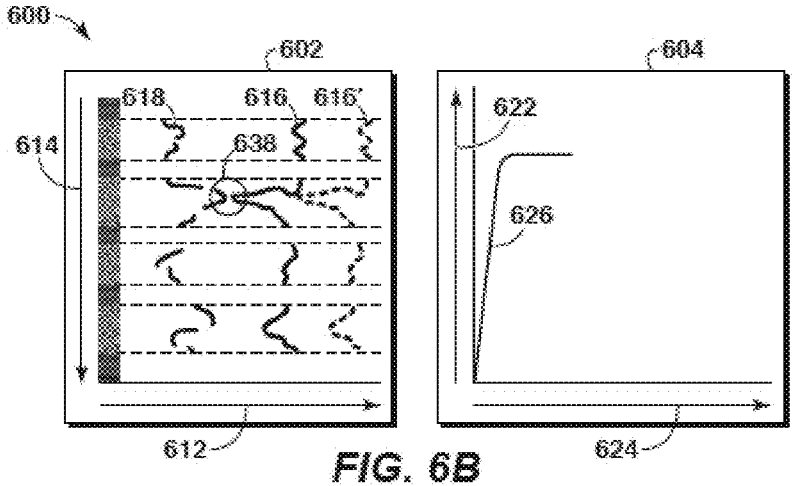
Figure 6C:
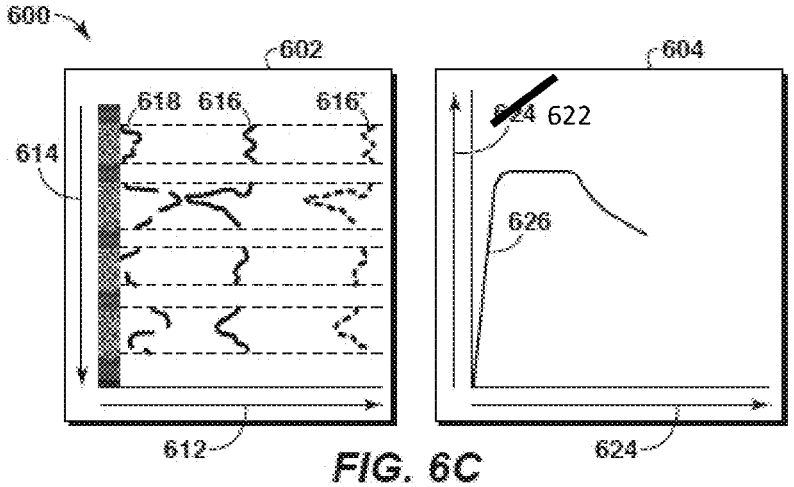

While the well potential of a simulated well accessing the reservoir may be simulated over space and time using suitable well models and/or suitable full-physics well models, determining an optimized well potential relative to the effective production capacity enables the modeled well potential to be used in making decisions related to the operation of the well. FIGS. 6A-6C help to illustrate the relationship between well potential and effective production capacity together with at least one example of a manner in which determining an optimized well potential relative to effective production capacity may be used in determining at least one aspect of a well operating plan. FIGS. 6A-6C each present a two-pane view 600 of a simulated production operation. The left pane 602 of each Figure presents a simulation of production potential 612 in units of flow rate (which may also be in units of pressure or other suitable units) along the x-axis and longitudinal position or contact position 614 in the well along the y-axis, illustrating both the simulated effective production capacity 616 and the simulated well potential 618 for consideration of the well potential relative to the effective production capacity. The right pane 604 presents a representation of flow rate 622 from the simulated well along the y-axis and the progression of time 624 along the x-axis. Accordingly, each of FIGS. 6A-6C illustrates the effective production capacity 616 and the well potential 618 as a function of longitudinal position in the well at a given time and the flow rate history 626 of the well up to that given time. As described above, the well potential and the effective production capacity may be measured in any suitable units, such as flow rate, pressure, etc.; FIGS. 6A-6C illustrate one implementation where potential and capacity are measured in terms of a maximum flow rate or a flow capacity.

Implementations of the present method may be configured to present operators with multiple views similar to those of FIGS. 6A-6C. For example, decision points may be identified from the simulations and presented to operators for consideration. Additionally or alternatively, dynamic views where the panes change over time may be presented for consideration. Still additionally or alternatively, the data presented in the views of FIGS. 6A-6C may be utilized in other suitable manners to assist operators in the decision-making process. For example, the data may be presented in a multitude of other manners depending on the questions and/or decisions being pursued by the operators. Additionally or alternatively, the data may be stored for later use and analysis by operators, models, etc. While the modeled well potential may be considered relative to the effective production capacity in any suitable manner (e.g. graphically, numerically, computationally, etc.), the visual comparison of FIGS. 6A-6C are illustrated here to facilitate the understanding of the present methods.

FIG. 6A (as well as FIGS. 6B and 6C) illustrates a longitudinal profile 632 of a simulated well in the left pane 602 that has been completed to provide multiple production intervals 634 illustrated by the dashed horizontal lines. The well potential plot 618 and the effective production capacity plot are broken into segments corresponding to the production intervals. As can be seen, the well potential 618 and the effective production capacity 616 are illustrated as allowing flow at the illustrated time, and the flow rate 626 in the right pane 604 illustrates that the well is producing at a first production rate 642.

FIG. 6B illustrates that the well potential 618 has remained relatively unchanged between the time of FIG. 6A and the later time of FIG. 6B. FIG. 6B further illustrates that the effective production capacity 616 has decreased during that time interval from the original effective production capacity 616' (shown in dashed line) to the current effective production capacity 616. As the well potential 618 has not changed and the effective production capacity remained higher than the well potential, the flow rate 626 remains unchanged as seen in the right page 604 of FIG. 6B. The illustration of FIG. 6B is representative of a hypothetical scenario for discussion purposes only. Actual simulations may include variations in well potential over time and may not reveal such a uniform decrease in effective production capacity over the length of the well. As is well understood, the potential of a reservoir may remain unchanged for a substantial time depending on various factors, such as the condition of the reservoir and whether associated injection operations are performed in nearby wells. Accordingly, the illustrated change in the time lapse between FIGS. 6A and 6B is representative only and may occur over days, months, or years.

As illustrated in FIG. 6B, the simulated well is at a condition where the effective production capacity 616 is nearly overlapping the well potential 618 in region 638. As described above, the intersections of the effective production capacity and the well potential indicate a condition at which a negative production event is likely to occur. Continued operation of the well under those conditions would lead to impairment of the production in zone 634*b* due to one or more failure mechanism, such as sand production, compaction-induced permeability loss, tubular failure, etc. Accordingly, FIG. 6C illustrates that between the time of FIG. 6B and the time of FIG. 6C the well is choked to reduce the production rate and the corresponding failure tendencies. In the simulation represented by FIGS. 6A-6C, the well potential 618 is reduced by choking the well at the surface resulting in the uniform reduction in well potential. FIG. 6C further illustrates that at the time represented by FIG. 6C the well potential has been reduced as far as possible in several of the intervals (i.e., to substantially no flow), which is reflected in the decline in the production flow rate 626 in pane 606. Operators presented with a well following the pattern of FIGS. 6A-6C (i.e., continually decreasing production rate) face the question of whether to take the well off production for work-over or other treatment operations.

As will be recalled, FIGS. 6A-6C are being discussed in the context of determining an optimized well potential relative to the characterized effective production capacity, which is step 416 of FIG. 4. FIGS. 6A-6C provide one example of a manner through which an optimized well potential may determined. For example, an operator reviewing FIGS. 6A-6C could promptly determine that an operation on the well that would change the well potential in the interval 634*b* would delay the need to choke the well (in the simulated well circumstances described above). For example, a completion or treatment that would reduce the well potential in interval 434*b* alone (i.e., without changing the potential in the other zones would delay the need to choke the well, thus enabling production rates to stay higher. When the methods of the present invention are conducted prior to drilling a well, the determined optimized well potential may affect drilling, completion, and/or production operations. For example, the completion equipment selected for a particular interval may be adapted to be controllable and/or responsive to maintain the well potential in the desired range. Additionally or alternatively, the present methods may be utilized prior to a treatment or workover decision to determine an optimized well potential for the well following the treatment/workover. Still additionally or alternatively, the present systems and methods may be used to anticipate or predict the occurrence of a negative production event and operate the well in a manner to avoid the event. For example, the modeling of FIGS. 6A-6C would enable an operator to choke the well before the onset of sand production (or other negative production event), potentially avoiding or strategically delaying the need for a workover or other more costly or complicated treatment.

The illustration of FIGS. 6A-6C is simplified in that it considers a relatively static well potential and a relatively static effective production capacity that change uniformly with time. In implementations where the physics of the well and/or near-well region provide more dynamic well potentials and/or effective production capacities over time and/or space, the determined optimized well potential may constitute an optimized well potential as a function of space and/or time.

FIGS. 6A-6C illustrate a method of determining a more optimized well potential (e.g., reducing the well potential of the entire well) via graphical observation and operator judgment. Such a determination allows the operator to delay the onset of a negative production event, which may be more costly than the reduction in production volumes, until a workover or treatment operation can be more economically conducted. For example, FIGS. 6A-6C further suggest to an operator that production rates can be improved by selectively reducing the well potential in interval 634*b*, which may be accomplished through a workover operation or other treatment operation. Accordingly, the present methods, such as may result in graphical representations like those in FIGS. 6A-6C, may allow an operator to plan operations in the region to plan workover or other treatment operations on particular wells at strategically important times to avoid the negative production events. Similarly, the present methods may allow an operator to know during the completion design phase that a particular completion tool should be installed in a particular interval. For example, controllable or adaptable completion equipment may be utilized in strategically important intervals, such as interval 634*b* in FIG. 6. In any event, the methods of the present disclosure allow the operator to better understand the relationship between the effective production capacity and the well potential and to thereby determine one or more aspects or components of the well operating plan, such as equipment and/or methods, to avoid negative production events and to thereby increase the efficiency of the operations.

Additionally or alternatively, optimized well potentials may be determined numerically through relationships between the reservoir model(s), the near-well model(s), and the well model(s), through algorithms relating the models and/or the results and inputs of the models, or through other computational means. In some implementations, the at least one optimized well potential may be determined based at least in part on an objective function that considers at least one of a plurality of decision-making factors. As used herein, the term "objective function" refers to any equations, combination of equations, models, simulations, etc. that consider the characterized effective production capacity, the modeled well potential, and one more decision-making factors to determine the well potential, as a function of time and/or space, that best approaches one or more operational objectives. Exemplary decision-making factors include those factors commonly considered in decisions about well operations, including production rates over time, production rates at a given time, operations costs, operational risks, reducing down time, etc., and combinations of the same. Accordingly, a simplified objective function may be configured to identify an optimized well potential relative to effective production capacity based on a consideration of a single decision-making factor, such as cost of completion equipment options, in order to meet an objective of minimizing completion costs. A more robust objective function may be configured to consider more decision-making factors, particularly factors that affect the long-term producibility of the well and the reservoir. Objective functions within the scope of the present disclosure may be configured to take advantage of the full-physics modeling of the simulated well and the simulated near-well region to consider the impact of various decisions over the life of the well on both the well and the formation.

With continuing reference to FIG. 4, it will be recalled that the present methods include determining at least one well operating plan component, at 418. The determined at least one well operating plan component is a component that can be incorporated into a well operating plan to provide the optimized well potential in a well accessing the reservoir for which the effective production capacity was characterized. As used herein, the term "well operating plan" is used to refer to the assortment of operations, steps, procedures, etc. that relate to the efforts to operate a well associated with the production of hydrocarbons. Accordingly, well operating plans include aspects related to drilling operations, completion operations, production operations, and treating operations.

Once a well operating plan is defined for a well associated with a reservoir, the modeled well potential for the well over space and time can be determined utilizing the methods described herein. However, the present methods may also be implemented in efforts to determine or define a well operating plan that provides the optimized well potential determined through the methods described herein. Accordingly, once an optimized well potential is determined as a function of space and/or time, operating plan components can be identified that can be incorporated into a well operating plan to provide the optimized well potential. Exemplary well operating plan components that may be determined in step 418 include one or more of equipment 424 and methods 426. For example, it may be determined that incorporating a particular piece of equipment in a completion can provide the optimized well potential (such as sand control equipment, in-flow control equipment, etc.). Additionally or alternatively, it may be determined that certain treating operations, such as acidizing, fracturing, etc., may need to be designed and executed in a manner that differs from conventional wisdom. The conventional wisdom, as described above is to maximize the initial production rate. However, a comparison of the production rates over time using the methods described herein may reveal that a completion or treatment option having a lower initial production may result in greater total production over time, such as when the initial production rate drops quickly and further for a first option and declines more slowly and/or less severely for a second option. Other equipment or methods may be considered for use in a well operating plan as well.

Due to the multitude of available combinations of equipment and methods that can be utilized in a well, some implementations may result in multiple operating plan components that can be utilized to provide the optimized well potential. In such implementations, the well operators may be able to select well operating plan components and/or combinations of components from the assortment available to provide the optimized well potential. Additionally or alternatively, in some implementations the optimized well potential over space and time may implicitly determine a corresponding optimized well operating plan, such as when a limited set of operating plan components are available to obtain the optimized well potential.

As can be understood from the foregoing, the methods of FIG. 4 result in a determined optimized well potential relative to a characterized effective production capacity and in one or more determined well operating plan components that can be incorporated into a well operating plan. In some implementations, the optimized well potential may be determined using one or more computers. Additionally or alternatively, the at least one well operating plan component may be determined using one or more computers. It will be appreciated that the present methods may be implemented in a variety of computer-system configurations including hand-held devices, multiprocessor systems, microprocessor-based or programmable-consumer electronics, mini-computers, mainframe computers, workstations, and the like. Any number of computer-systems and computer networks are therefore acceptable for use with the present technology. The present methods may be practiced in distributed-computing environments where tasks are performed by remote-processing devices that are linked through a communications network. In a distributed-computing environment, the software may be located in both local and remote computer-storage media including memory storage devices. Additionally, unless specifically stated otherwise, it is appreciated that discussions herein utilizing terms such as "processing," "computing," "calculating," "determining," or the like refer to the action and/or processes of a computer or computing system, or similar electronic computing device, that manipulate and/or transform data, which is representative of physical characteristics of the well, the formation, and/or the reservoir, within the computing system's registers and/or memories into other data, similarly representative of physical characteristics of the well, the formation, and/or the reservoir, within the computing system's memories, registers or other such information storage devices.

Figure 7:
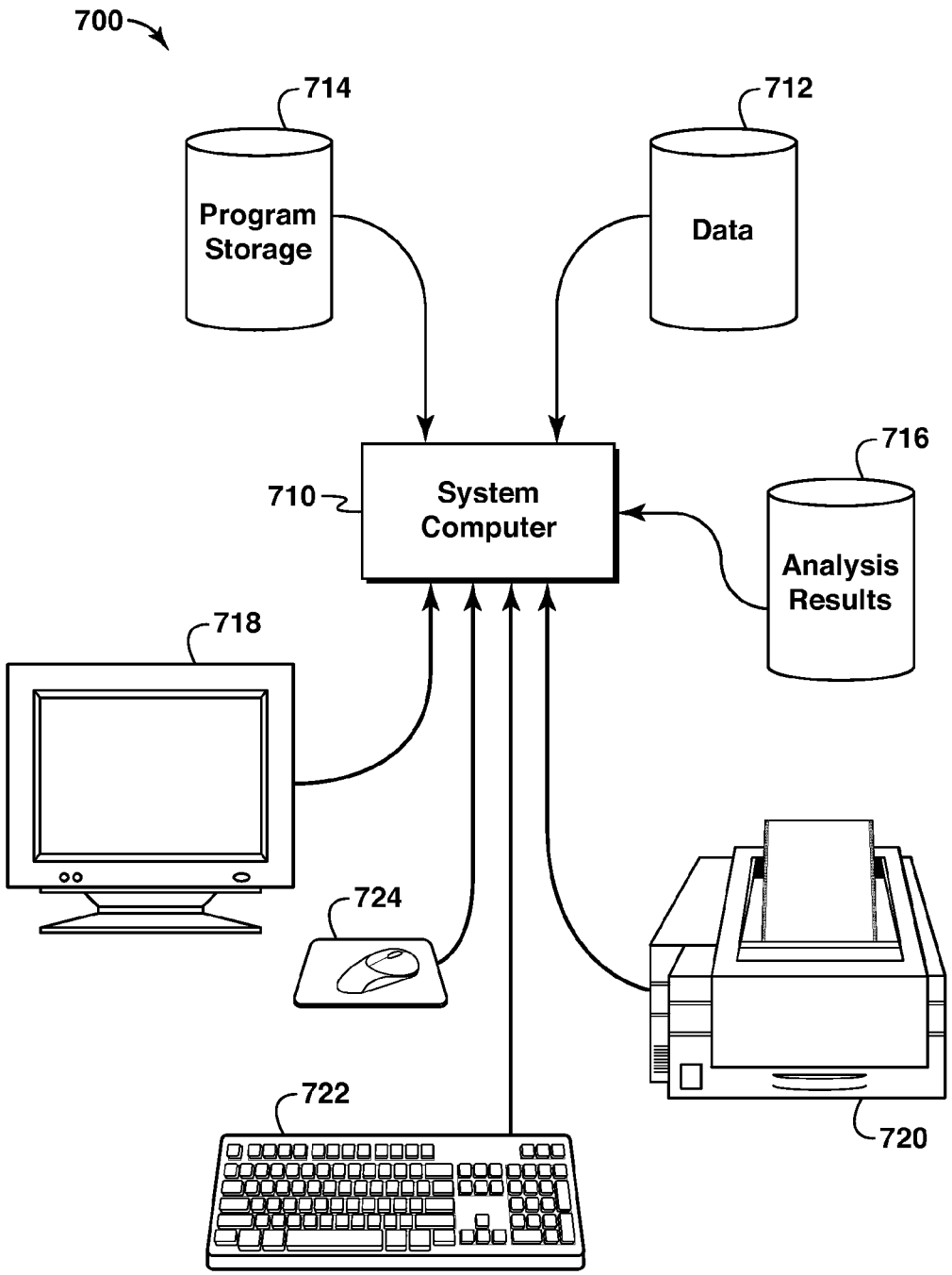
FIG. 7 provides a schematic illustration of a system within the scope of the present inventions.

FIG. 7 illustrates a simplified computer system 700, in which methods of the present disclosure may be implemented. The computer system 700 includes a system computer 710, which may be implemented as any conventional personal computer or other computer-system configuration described above. The system computer 710 is in communication with representative data storage devices 712, 714, and 716, which may be external hard disk storage devices or any other suitable form of data storage. In some implementations, data storage devices 712, 714, and 716 are conventional hard disk drives and are implemented by way of a local area network or by remote access. Of course, while data storage devices 712, 714, and 716 are illustrated as separate devices, a single data storage device may be used to store any and all of the program instructions, models, simulations, measurement data, results, operating plan components, etc. as desired.

In the representative illustration, the data to be input into the systems and methods, such as data regarding the reservoir, the near-well region, and/or the well, are stored in data storage device 712. The system computer 710 may retrieve the appropriate data from the data storage device 712 to perform the operations and analyses described herein according to program instructions that correspond to the methods described herein. For example, the program instructions may be configured to simulate the well, the near-well region, and/or the reservoir to determine the optimized well potential. The program instructions may be written in any suitable computer programming language or combination of languages, such as C++, Java and the like. The program instructions may be stored in a computer-readable memory, such as program data storage device 714. The memory medium storing the program instructions may be of any conventional type used for the storage of computer programs, including hard disk drives, floppy disks, CD-ROMs and other optical media, magnetic tape, and the like.

While the program instructions and the input data can be stored on and processed by the system computer 710, the results of the methods described herein may be exported for use in developing one or more optimized well operating plans, such as indicated at step 432 in FIG. 4. For example, one or more of the determined optimized well potential 434 and the determined well operating plan components 436 may exist in data form on the computer system 700 and may be exported for use in developing an optimized well operating plan. For the purposes of the present disclosure, exporting refers to storing one or more of the well operating plan components and/or one or more optimized well potentials for machine interpretation, storing one or more of the same for manipulation by an operator in further steps, such as design and/or implementations steps, and/or displaying one or more of the same for visualization by operators. For example, the simplified graphical presentation of FIGS. 6A-6C may be exported for visualization by operators for use in developing a well operating plan. Additionally or alternatively, lists of available well operating plan components may be exported for visualization, such as on a display or printed output, for use in developing an operating plan.

According to the representative implementation of FIG. 7, the system computer 710 presents output onto graphics display 718, or alternatively via printer 720. Additionally or alternatively, the system computer 710 may store the results of the methods described above on data storage device 716, for later use and further analysis. The keyboard 722 and the pointing device (e.g., a mouse, trackball, or the like) 724 may be provided with the system computer 710 to enable interactive operation. The graphics display 718 of FIG. 7 is representative of the variety of displays and display systems capable of presenting visualizations. Similarly, the pointing device 724 and keyboard 722 are representative of the variety of user input devices that may be associated with the system computer. The multitude of configurations available for computer systems capable of implementing the present methods precludes complete description of all practical configurations. For example, the multitude of data storage and data communication technologies available changes on a frequent basis precluding complete description thereof. It is sufficient to note here that numerous suitable arrangements of data storage, data processing, and data communication technologies may be selected for implementation of the present methods, all of which are within the scope of the present disclosure.

With returning reference to FIG. 4, it can be seen that some implementations of the present methods may be continued by actually implementing a well operating plan, at box 438, incorporating the at least one well operating plan component determined to be able to provide the optimized well potential. As described above, the well operating plan encompasses a range of possible steps in the lifecycle of a well. Depending on the stage in the life of the well at which the present methods are utilized, the implementation of a well operating plan may include one or more of drilling a well, completing a well, producing a well, and/or treating a well including one or more of the determined well operating plan components. For example, an exemplary implementation may include selecting completion equipment for inclusion in a completion. Additional exemplary implementations may include producing the well at a certain degree of choke to maintain the well potential at the determined optimized level relative to the effective production capacity over space and/or time. Still additional exemplary implementations may include treating the well in a manner to obtain the determined optimized well potential.

FIG. 4 further illustrates that some implementations of the present methods may include producing hydrocarbons from the well, at box 440. The production of hydrocarbons may be according to conventional production operations. Additionally or alternatively, the hydrocarbon production operations may be based at least in part on consideration of the optimized well potential. For example, when the well operating plan identified to provide the determined optimized well potential includes production-related decisions or components, the production operations may be based at least in part on results of the present methods. Applying some degree of choke on the well to reduce the well potential is one example of how the production operations may be based at least in part on the results of the present methods and one manner in which production related decisions can be made using the present methods.

Figure 8:
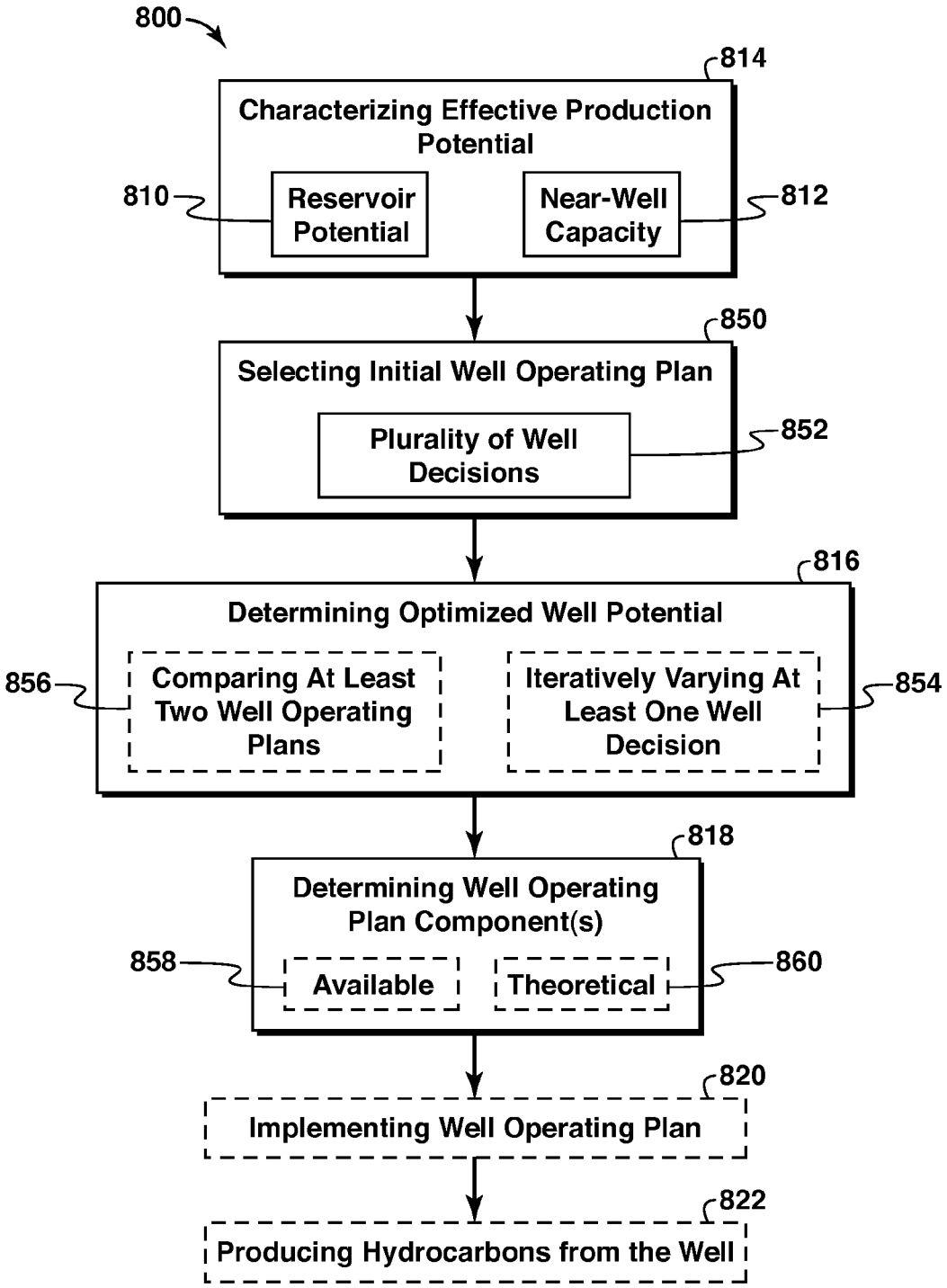
FIG. 8 provides a flowchart of methods within the scope of the present inventions.

FIG. 8 is another flow chart schematically illustrating methods of making decisions regarding hydrocarbon well operations. Due to the similarities between FIG. 4 and FIG. 8, like elements will be referred to by like reference numerals. Additionally, elements of FIG. 8 that were described in connection with FIG. 4 are not described to the same level of detail in connection with FIG. 8 in the interest of brevity and clarity. Similar to FIG. 4, the decision-making methods 800 of FIG. 8 include the three primary steps of 1) characterizing effective production capacity 814, which is based at least in part on the characterized reservoir potential 810 and the characterized near-well capacity 812; 2) determining optimized well potential 816; and 3) determining well operating plan components 818. Additionally, FIG. 8 illustrates that in some implementations, the methods of the present invention include selecting an initial well operating plan, at box 850. As discussed above, well operating plans may include plans related to operations ranging from drilling operations to completion operations to production operations to treatment operations. As is readily appreciated, even a simple well operating plan may include a plurality of well decisions, or decisions related to operations on the well, at box 852. Exemplary decisions include decisions affecting drilling conditions, decisions affecting the completion profile, decisions affecting the production rate, etc.

In some implementations, the methods of the present invention include utilizing a well model to determine the well potential of a well operating plan, such as the initial well operating plan, which well operating plan includes a plurality of decisions over the well's expected life or a period of the well's expected life, such as schematically illustrated at box 816. FIG. 8 further illustrates that some implementations of the methods of the present invention may include iteratively varying at least one well decision, at box 854, in efforts to determine an optimized well potential 816. In the context of the graphical illustration of FIG. 6, the positions or configurations of the well potential line 618 may vary with each iterative variation of one or more well decision. Similarly, as the near-well region is often affected by the well decisions, the near-well models may be updated iteratively to characterize the near-well capacity 812 for each iteration of the well decisions. Accordingly, the near-well capacity, the effective production capacity, and the well potential may each be modeled or characterized for each iteration of the well operating plan in pursuit of the optimized well potential. In some implementations, the determined well potential at each iteration may be considered relative to the effective production capacity using an objective function to determine whether the particular combination of well decisions provides an optimized well potential. An exemplary well operating plan may relate to completion operations and may include decisions regarding completion equipment choices for one or more intervals of the well. Some implementations of the present methods may include iteratively varying the selected equipment in one or more of those intervals until the well potential is determined to be an optimized well potential according to an objective function. Additionally or alternatively, the well potential of successive iterations may be compared against each other to determine which well potential and corresponding set of well decisions forming a well operating plan provides an optimized well potential relative to the characterized effective production capacity. Still additionally or alternatively, some implementations may compare the determined well potential of each iteration against the determined optimized well potential relative to the effective production capacity.

In some implementations, the step of determining an optimized well potential is done without reference to particular decision options, such as available equipment or known methods, to provide a theoretical optimized well potential. In such implementations, the iteratively varied well decisions may be considered unconstrained. The well potential of various well operating plans may then be determined using the models described above and compared to the optimized well potential until an optimized well operating plan is identified. In some implementations, the unconstrained iterations of well decisions may identify an optimized well potential that is not readily attainable using conventional equipment and methods. Far from being a failure, such implementations provide opportunities to engineer and/or invent new equipment and methods to optimize well operating plans, which equipment and methods could be used in other implementations.

Additionally or alternatively, the iterations of well decisions may be limited to combinations of well decisions utilizing available methods and/or equipment. For example, a well operating plan utilizing available or known equipment and methods may be developed and a corresponding well potential determined and compared against the determined optimized well potential relative to the effective production capacity. This process may be repeated until a best match is found between the well potential of an available well operating plan and the determined optimized well potential.

FIG. 8 further illustrates that in some implementations, determining the optimized well potential may include comparing at least two well operating plans, at box 856, which may each comprise distinct sets of well decisions. As described above, the optimized well potential may be determined utilizing an objective function to consider the relationship between the well potential and the effective production capacity and to identify an optimized well potential relative to the effective production capacity. Additionally, the optimized well potential may be determined by comparing the well potentials of at least two well operating plans over at least a period of the well's expected life. The comparison of two distinct operating plans may reveal which of the operating plans provides a more optimal relationship between the well potential and the effective production capacity. Additionally or alternatively, an objective function may still be used to assist operators in evaluating the differences in relative well potentials between the two or more well operating plans. The use of an objective function may be particularly useful in implementations where the simulations and determinations are done computationally without visual comparisons by the operators. Alternatively, the operator may visually compare the well potential and/or simulated production rates of the two or more well operating plans to determine which of the plans provides an optimized well potential relative to the effective production capacity.

Continuing with the schematic flow chart of FIG. 8, the decision-making method 800 can be seen to include determining well operating plan components 818 once the optimized well potential has been determined. As seen in the discussion above, the step of determining an optimized well potential, at 816, may include determining well potentials for various combinations of well operating plan components. In such implementations, the step of determining well operating plan components may be considered part of the well production potential optimization step, which provides one example of how steps illustrated as separate steps can be integrated into a single step without deviating from the present invention. It should be understood that steps and/or features described separately may be combined into one and that steps and/or features described as one may be separated without deviating from the present invention. Additionally or alternatively, the step of determining well operating plan components that can be incorporated into a well operating plan providing the optimized well potential, at box 818, may be done after an optimized well potential has been determined, even when the optimized well potential is determined through the assistance of iteratively or comparatively considering multiple well operating plans.

The step of determining one or more well operating plan components 818 may be substantially similar to the manner in which that step was described above in connection with FIG. 4. Additionally, determining operating plan components 818 may include determining one or more well operating plan components (e.g., methods and/or equipment) from among available well operating plan components, box 858, and/or theoretical well operating plan components, box 860. As described above, some implementations may prefer to select operating plan components from among available, or known, equipment and methods. In other implementations, determining operating plan components including theoretical equipment and/or methods to provide the determined optimized well potential may provide operators opportunity to improve well operations far greater than expected through the development of new equipment and/or methods.

FIG. 8 further illustrates that the decision-making method 800 may include the steps of implementing the well operating plan 820 in a well accessing a reservoir and producing hydrocarbons from the well 822. These steps may be done according to conventional practice to implement the decisions laid out in the determined well operating plan.

It should be noted that not every implementation will include the step of producing hydrocarbons from the well. For example, the present methods, whether as described in FIG. 8 or any of the other Figures, may be utilized in operating an injection well that is not intended to ever produce hydrocarbons. While the present disclosure talks primarily of the well potential in terms of the well's ability to receive formation fluids, the well potential in an injection well is similar, referring to the ability of the well to move injected fluids into the formation.

With reference to FIGS. 5 and 9-11, various scenarios representing exemplary implementations of the present methods are illustrated in the schematic representative manner described above in connection with FIG. 5, wherein an intersection between the effective production capacity and the well potential is indicative of a condition likely to trigger a negative production event. As described above, the present methods determine an optimized well potential, as a function of space and/or time, using both a well model and a near-well model, each of which may be based at least in part on full-physics modeling. The use of both a well model and a near-well model allows the operator to determine both a well potential and an effective production capacity, which effective production capacity considers the near-well capacity. As is understood, the near-well capacity and the well potential each may vary over both time and space due to the multitude of processes occurring downhole. As a simple example, particulate or fines movement may affect each of the well potential and the near-well capacity in different ways. Additionally or alternatively, scale buildup and/or filter-cake buildup may affect each of the well potential and the near-well capacity in different ways. Accordingly, the operators may be better able to make accurate, time and space based determinations of an optimized well potential.

Figure 9A:
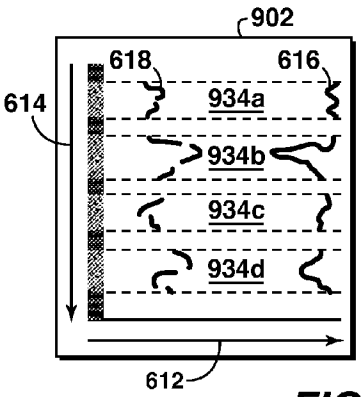
FIGS. 9A-9D provide schematic representations of effective production capacity and well potential by interval at different times and production rate histories over time.
Figure 9B:
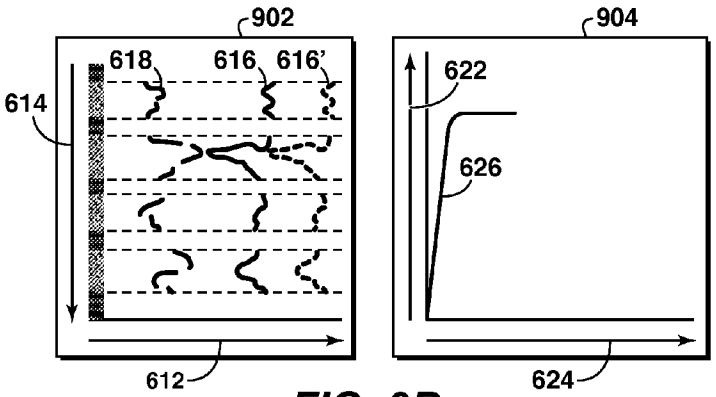
Figure 9C:
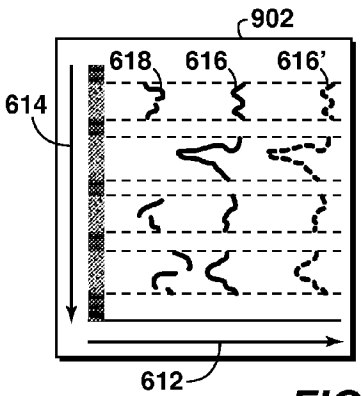
Figure 9D:
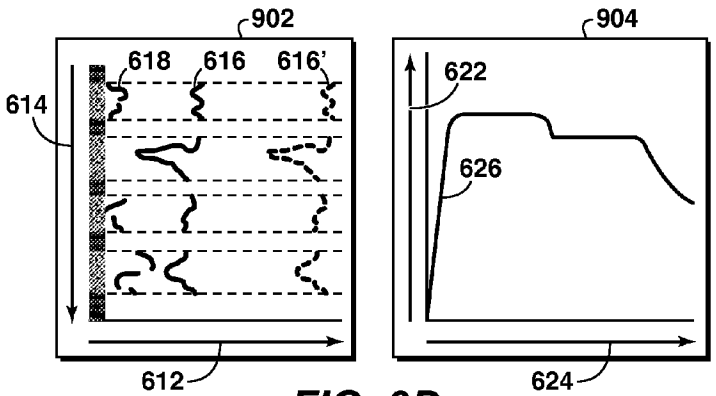
Figure 10A:
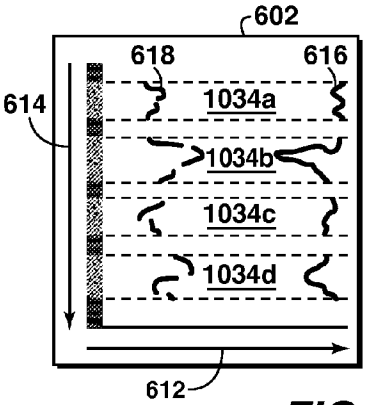
FIGS. 10A-10D provide schematic representations of effective production capacity and well potential by interval at different times and production rate histories over time.
Figure 10B:
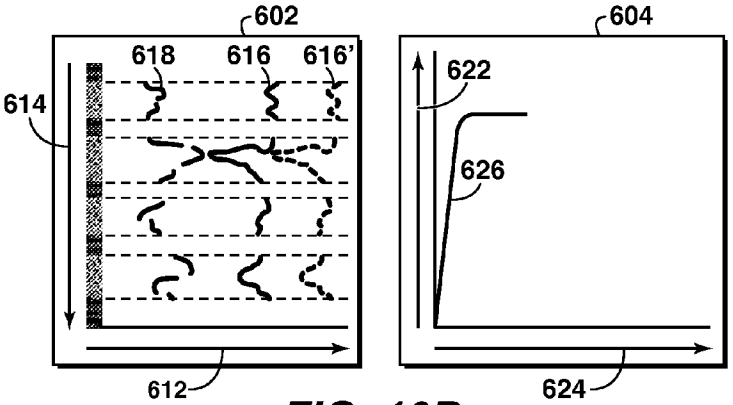
Figure 10C:
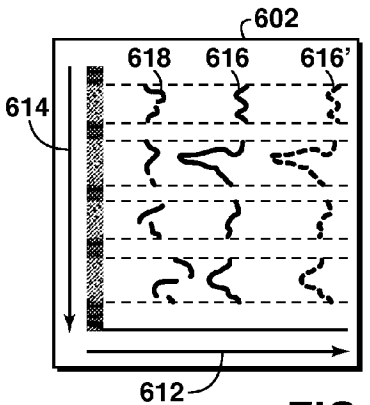
Figure 10D:
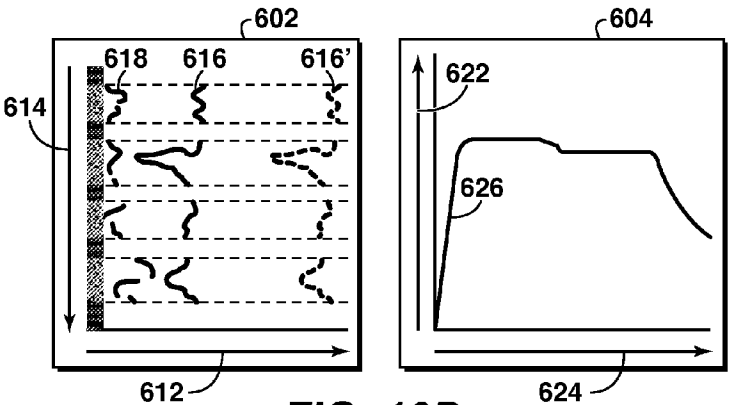

FIG. 9, much like FIG. 6, includes multiple Figures, FIGS. 9A-9D, illustrating the time-lapse operation of a simulated well. As with FIG. 6, each of FIGS. 9A-9D include two panes 902, 904 to illustrate the affect on production rates over time as the relationship between well potential and effective production capacity changes over time. Elements of FIG. 9 having corresponding elements in FIG. 6 are referenced by corresponding reference numerals and are not explained in detail here for purposes of brevity. FIGS. 9A and 9B can be seen to present a scenario substantially identical to the scenario of FIGS. 6A and 6B where the well is producing at a given rate. FIG. 9C represents the well potential of the simulated well at a point in time just after a well decision has been made to close the second interval from the top 934*b* (see FIG. 9A). As will be recalled from the illustrations of FIG. 6, the second interval 934*b* presents the production limiter that required choking of the entire well and a corresponding reduction in production rates. As seen in FIG. 9C, however, no such production limit is presented because of the decision to stop production entirely from interval 934*b* while maintaining production in the remaining intervals. Considering FIG. 9C, it can be seen that production rates have dropped slightly due to the closure of interval 934*b*, but that production rates stay relatively high for some time before the well needs to be choked because of the approaching overlap in interval 934*d*, which choking is shown in FIG. 9D. Comparing the illustrations of FIG. 6 with the illustrations of FIG. 9, it can be seen that production from the well is able to continue for longer time and at a higher rate before the production rate drops to the point where a workover might be considered.

FIG. 9 illustrates one example of using the present invention to determine an optimized well production potential. In the example of FIG. 9, it may be said that closing a single problematic interval at a given point in time is better than choking the entire well at that time, as shown in FIG. 6, at least with respect to production rates. Numerous technologies are available for selectively closing a wellbore interval during production operations, including the use of sliding sleeves, inflow control devices, etc. The step of determining at least one well operating plan component includes selecting the technology (e.g., equipment and/or methods) to provide the time- and space-dependent well potential. As one example of suitable technology, controllable and/or adaptive completion equipment is being developed and used in the industry. Some of this equipment includes control lines extending to the surface for automated or manual control and others are configurable to be self-adaptive depending on downhole conditions, such as pressure changes, temperature changes, fluid composition changes, etc.

While the well operating plan providing the well potential schematically illustrated in FIG. 9 may result in a higher production rate as compared to FIG. 6, it should be recalled that higher production rates is only one factor that may be considered by the present methods in determining the optimized well potential. As described above, the determination, which may incorporate the use of one or more objective functions, may consider factors such as materials costs, operational complexity and time requirements, operational risks, etc. Accordingly, a simple comparison of simulated production rates between FIG. 6 and FIG. 9 is not sufficient to conclude that one is optimized relative to the other. For example, it may be concluded that the equipment required to close the interval is too costly or too risky to justify the relative increase in production. The combination of FIG. 6 and FIG. 9 is illustrative, however, of aspects of the present methods described above where well potentials of different well operating plans are compared in an effort to determine an optimized well potential. FIG. 6 and FIG. 9 illustrate well potentials over time and space of two different well operating plans and the corresponding impact on production rates. Additional plots could be generated to represent factors such as costs, risks, etc. to compare the full impact of the different well operating plans on the efficiency of the well. Operators utilizing the present invention may consider the comparative plots to determine an optimized well potential for the well over space and time, which may be that of FIG. 6, that of FIG. 9, or another well potential.

FIG. 10 is like unto FIG. 9 in that it shows another series of time-lapse representations of well potential, effective production capacity, and production. Elements of FIG. 10 having corresponding elements in FIG. 6 are referenced by corresponding reference numerals and are not explained in detail here for purposes of brevity. FIGS. 10A and 10B follow the pattern of FIGS. 6 and 9 where the production rate continues at a representatively level rate while the well potential remains unchanged. FIG. 10C illustrates an implementation of the present methods where the well operating plan includes an adaptive or controllable completion, such as those described above, in interval 1034*b* that reduces the well potential in the interval without completely closing the interval. As can be seen comparing FIG. 10C and FIG. 9C, the result of reducing the well potential without closing the interval is that the production rate decrease is smaller in the well operating plan of FIG. 10 than in the well operating plan of FIG. 9. As described above, the present methods may result in the well potential of FIG. 10 being determined to be an optimized well potential. Additionally or alternatively, the well potential of FIG. 10 may represent merely one of many well potentials calculated in iterative and/or comparative efforts to determine an optimized well potential.

As described above, the well potentials illustrated in FIGS. 6, 9, and 10 may or may not represent an optimized well potential for any particular well. Additionally, many implementations of the present invention may never produce displays or outputs similar to those of FIGS. 6, 9, and 10. However, it should be understood that such representations are illustrative of the types of data and properties that may be considered by computer systems, with or without operator input, in determining optimized well potentials. In some implementations, operators may incorporate substantially all of the decision-making factors into one or more objective functions such that a computer system can identify a single well operating plan from a library of well operating plans that provides the optimized well potential in light of the factors identified as relevant. Additionally or alternatively, the computer system may be configured to vary the well operating plan successively or iteratively changing one or more aspect of the plan with each iteration until an optimized well operating plan is identified in light of the factors identified as relevant. Additionally or alternatively, the computer system may not be provided with substantially all the relevant factors and may present the user with time- and space-dependent descriptions of the well potential, such as may be described graphically, numerically, or through the use of equations. In such circumstances, the operator may be able to identify operating plan components that provide or approximate the optimized well potential, in light of additional factors considered by the operator.

Still additionally, some implementations of the present methods may allow the operator to identify two or more potential well operating plans, such as an existing well operating plan and one or more proposed operating plans, such as various possible workover plans. The present methods may be utilized to determine the well potential for each of the identified potential operating plans. As described above in connection with FIG. 8, the well potentials may be compared in accordance with the present methods and an optimized well potential may be determined FIGS. 6, 9, and 10 may be considered together as an example of such a comparison step between potential well operating plans. For example, FIG. 6 may represent the well potential of a currently operating production well should production continue according to a current operating plan including choking the well starting at the time shown in FIG. 6B. FIGS. 9 and 10 may each represent alternative workover treatments that can be performed on the well. In an exemplary situation, an operator may be considering whether to conduct a workover and what type of workover would be most effective. By considering the relative well potentials of FIGS. 9 and 10, together with other factors, the operator would be able to objectively determine which of the operating plans would be most preferred over the life of the well, or at least over the period of the well's life being considered by the models. For example, the present methods may include considering factors such as costs, risks, regulatory limitations, availability of equipment, etc. In some implementations, the present methods may reveal that the proposed treatments are not justified under the circumstances or that relatively expensive or risky treatments would be worth the cost or risk due to the degree of improvement expected.

FIG. 11 illustrates still additional aspects of the present invention. FIG. 11 follows the pattern of FIGS. 6, 9, and 10 in that it includes multiple time-lapse views of a well operating plan in FIGS. 11A-11C. Elements of FIG. 11 having corresponding elements in FIG. 6 are referenced by corresponding reference numerals and are not explained in detail here for purposes of brevity. FIG. 11 illustrates an optimized well potential wherein the well potential is optimized in each interval and in each time period. In such a scenario, the present methods may be utilized to determine an optimized well potential that at least substantially harmonizes with or that is at least substantially synchronous with the characterized effective production capacity. As illustrated, the well potential is at least substantially synchronous with the effective production capacity over all of the temporal and spatial spans considered. Additional or alternative implementations may render the well potential synchronous with the effective production capacity over only limited portions of the well, either temporally or spatially, such as in only one or more intervals or only during a particular period in the well's expected life. By comparing FIG. 11 with FIGS. 6, 9, and 10, it can be seen that the optimized well potential (i.e., the highest well potential available based on the production limits in the example) produces the highest production rate and highest total production of all the illustrated examples. FIG. 11 illustrates that maximizing the well potential relative to the effective production capacity will maximize the production rate under the operational conditions and the total production. By using near-well models based at least in part on full-physics modeling of a simulated well, users of the present methods are able model the well and the near-well region more accurately. By extension, the well potential and effective production capacity are more accurately characterized over time and space, thereby allowing the users to determine optimized well potentials.

As may be understood from the foregoing description, some implementations of the present methods may result in the development of a system associated with the use of hydrocarbons, such as a well operatively connected to a reservoir. The well of the system includes at least one component selected based at least in part on a computerized simulation adapted to: 1) characterize effective production capacity of the reservoir over space and time based at least in part on the reservoir potential and the near-well capacity; 2) determine an optimized well potential over space and time relative to the characterized effective production capacity using a well model; and 3) determine at least one component that can be incorporated into a well operating plan to provide the optimized well potential in the well. For example, the at least one component selected based at least in part on the computerized simulation may be selected from at least one of equipment and methods, such as drilling methods, completion methods, production methods, treatment methods, completion equipment, production equipment, etc. In some implementations, the equipment determined to be incorporated into the well operating plan may be developed based at least in part on results of the computerized simulation. For example, customized or innovative equipment may be required to approximate the optimized well potential determined by the computerized system. The computerized simulation may be adapted to further utilize an objective function and/or user input to consider factors relevant to determining the optimized well potential, such as cost of equipment, operational risks, regulatory limitations, etc. Additionally or alternatively, the computerized simulation may determine the optimized well potential according to any one or more of the methods described above. For example, the computerized simulation may iteratively vary one or more well operating decisions, may compare distinct well operating plans, and/or may determine a theoretical physics-based optimum unconstrained by currently available methods and equipment.

Similarly, it should be understood from the foregoing that the present invention includes computerized systems adapted to perform one or more of the methods described above. More particularly, and as suggested by the description of FIG. 7 above, the present invention includes a system for optimizing hydrocarbon well decision-making. The system may include a processor, a storage medium, and a computer application accessible by the processor and stored on at least one of the storage medium and the processor. The system may include any of the other features, components, and abilities of currently available or future developed computational systems, including systems ranging from simple personal-use computational systems to complex computational systems adapted for complex simulations. The computer application may be in any suitable form adapted to perform one or more of the methods described herein. For example, a suitable computer application is adapted to 1) characterize effective production capacity of a reservoir over space and time based at least in part on a reservoir model (and characterized reservoir potential) and a near-well model (and characterized near-well capacity); 2) determine an optimized well potential over space and time relative to the characterized effective production capacity using a well model; and 3) determine at least one well operating plan component that can be incorporated into a well operating plan to provide the optimized well potential in a well accessing the reservoir.

While the techniques of the present invention may be susceptible to various modifications and alternative forms, the exemplary embodiments discussed above have been shown by way of example. It should again be understood that the invention is not intended to be limited to the particular embodiments disclosed herein. Indeed, the present invention includes all modifications, equivalents, and alternatives falling within the spirit and scope of the appended claims.

The invention claimed is:

1. A method for hydrocarbon well decision-making, the method comprising:

characterizing reservoir potential of a reservoir over space and time using a reservoir model;

characterizing a near-well capacity of a formation adjacent to a well drilled to access the reservoir using a near-well model of a simulated well accessing the reservoir, the near-well model considering effects on the formation over time and space due to at least one of particulate movement, filter-cake presence, and scale build-up, wherein the near-well capacity comprises a capacity of the formation adjacent to the well to flow fluids without one of triggering and initiating a negative production event;

characterizing an effective production capacity based at least in part on the characterized reservoir potential as modified by the characterized near-well capacity;

determining an optimized well potential over space and time relative to the characterized effective production capacity using a well model; and determining at least one well operating plan component that can be incorporated into a well operating plan to provide the determined optimized well potential in a well accessing the reservoir.

2. The method of claim 1 wherein the determined optimized well potential is determined based at least in part on an objective function that considers at least one of a plurality of decision-making factors.

3. The method of claim 2 wherein the objective function considers at least one of operations costs, operational risks, and modeled production rates over a life of the well.

4. The method of claim 2 wherein the well model determines the determined optimized well potential of a well operating plan in the simulated well; and wherein determining the optimized well potential determines a corresponding optimized well operating plan.

5. The method of claim 1 wherein the well model determines the optimized well potential of a well operating plan comprising a plurality of well decisions over a period of a well's expected life; wherein the near-well model determines the characterized near-well capacity of the formation adjacent to the simulated well operated according to the well operating plan; and wherein determining the optimized well potential includes iteratively varying one or more of the plurality of the well decisions.

6. The method of claim 5 wherein the well operating plan includes decisions related to one or more of drilling operations, completion operations, production operations, and treatment operations.

7. The method of claim 5 wherein the iteratively varied one or more of the plurality of well decisions are limited to combinations of well decisions utilizing available methods and equipment.

8. The method of claim 5 wherein the iteratively varied one or more of the plurality of well decisions are unconstrained; and wherein the determined optimized well potential identifies a well operating plan requiring at least one of theoretical methods and theoretical equipment.

9. The method of claim 5 wherein iteratively varying the one or more of the plurality of well decisions affects the determined optimized well potential, the near-well capacity, and the effective production capacity; and wherein determining the optimized well potential includes comparing at least two well operating plans comprising distinct sets of well decisions.

10. The method of claim 9 wherein one of the at least two well operating plans comprises a well operating plan describing an existing well operation; and wherein at least one additional plan comprises a proposed operating plan including a treatment operation.

11. The method of claim 1 wherein determining the optimized well potential determines a well potential synchronous with the characterized effective production capacity over at least a subset of spatial and temporal spans of the well potential and the characterized effective production capacity.

12. The method of claim 1 further comprising exporting at least the optimized well potential for use in developing an optimized well operating plan.

13. The method of claim 12 further comprising exporting at least the determined optimized well potential and the at least one well operating plan component for use in developing the optimized well operating plan.

14. The method of claim 13 further comprising implementing the optimized well operating plan in the well accessing the reservoir.

15. The method of claim 1 further comprising implementing the well operating plan incorporating the at least one well operating plan component.

16. The method of claim 15 further comprising producing hydrocarbons from the reservoir through the well.

17. A system associated with production of hydrocarbons, the system comprising:

a well operatively connected to a subsurface reservoir; wherein the well includes at least one component selected based at least in part on a computerized simulation constructed and arranged to: 1) characterize reservoir potential of the subsurface reservoir over space and time using a reservoir model; 2) characterize near-well capacity of a formation adjacent to the well using a near-well model of a simulated well accessing the reservoir, the near-well model considering effects on the formation over time and space due to at least one of particulate movement, filter-cake presence, and scale build-up, wherein the near-well capacity comprises a capacity of the formation adjacent to the well to flow fluids without one of triggering and initiating a negative production event; 3) characterize an effective production capacity based at least in part on the characterized reservoir potential as modified by the characterized near-well capacity; 4) determine an optimized well potential over space and time relative to the characterized effective production capacity using a well model of the simulated well accessing the reservoir; and 5) determine at least one component that can be incorporated into a well operating plan to provide the determined optimized well potential in the well.

18. The system of claim 17 wherein the at least one component selected based at least in part on the computerized simulation is selected from equipment.

19. The system of claim 18 wherein the selected equipment is developed based at least in part on results of the computerized simulation.

20. The system of claim 17 wherein the well operating plan incorporating the at least one component is a well operating plan related to at least one of well construction operations, well completion operations, well production operations, and well treatment operations.

21. The system of claim 17 wherein the determination of the at least one component that can be incorporated into a well operating plan is constrained to available equipment.

22. A system for optimizing hydrocarbon well decision-making, the system comprising:

a processor;

a non-transitory storage medium; and a computer application accessible by the processor and stored on at least one of the non-transitory storage medium and the processor, the computer application constructed and arranged to:

characterize reservoir potential of a reservoir over space and time using a reservoir model;

characterize near-well capacity of a formation adjacent to a well using a near-well model of a simulated well accessing the reservoir, the near-well model considering effects on the formation over time and space due to at least one of particulate movement, filter-cake presence, and scale build-up, wherein the near-well capacity comprises a capacity of the formation adjacent to the well to flow fluids without one of triggering and initiating a negative production event;

characterize an effective production capacity based at least in part on the characterized reservoir potential as modified by the characterized near-well capacity;

determine an optimized well potential over space and time relative to the characterized effective production capacity using a well model of the simulated well accessing the reservoir; and determine at least one component that can be incorporated into a well operating plan to provide the determined optimized well potential in the well.

* * * * *